US007024138B2

(12) United States Patent
Ikeda et al.

(10) Patent No.: US 7,024,138 B2
(45) Date of Patent: Apr. 4, 2006

(54) IMAGE FORMING APPARATUS, AND REPLENISHING DEVELOPER KIT

(75) Inventors: Naotaka Ikeda, Ibaraki (JP); Kenji Okado, Ibaraki (JP); Kazumi Yoshizaki, Ibaraki (JP); Hironori Minagawa, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 49 days.

(21) Appl. No.: 10/765,033

(22) Filed: Jan. 28, 2004

(65) Prior Publication Data

US 2004/0184838 A1 Sep. 23, 2004

(30) Foreign Application Priority Data

Feb. 28, 2003 (JP) ..... 2003-052329

(51) Int. Cl.
*G03G 15/01* (2006.01)

(52) U.S. Cl. ..... 399/227; 399/226

(58) Field of Classification Search ..... 399/223, 399/224, 227, 298, 299, 301, 302, 303; 430/111.1, 430/111.3, 120
See application file for complete search history.

(56) References Cited

U.S. PATENT DOCUMENTS

| | | | | |
|---|---|---|---|---|
| 6,449,451 | B1 * | 9/2002 | Tsuruya et al. | 399/223 |
| 6,841,327 | B1 * | 1/2005 | Otake et al. | 430/120 |
| 2003/0091922 | A1 | 5/2003 | Okado et al. | 430/111.33 |
| 2003/0223782 | A1 | 12/2003 | Ban et al. | 399/227 |

FOREIGN PATENT DOCUMENTS

| | | |
|---|---|---|
| JP | 36-10231 | 7/1936 |
| JP | 56-13945 | 4/1981 |
| JP | 59-53856 | 3/1984 |
| JP | 59-61842 | 4/1984 |
| JP | 59-100471 | 6/1984 |
| JP | 62-49377 | 3/1987 |
| JP | 64-43301 | 2/1989 |
| JP | 2-21591 | 5/1990 |
| JP | 3-145678 | 6/1991 |
| JP | 2001-265088 | 9/2001 |
| JP | 2002-328493 | 11/2002 |

OTHER PUBLICATIONS

*Patent Abstracts of Japan, Publication No. 62-049377, Mar. 4, 1987.
Patent Abstracts of Japan, Publication No. 2001-265088, Sep. 28, 2001.
Patent Abstracts of Japan, Publication No. 2002-328493, Nov. 15, 2002.

* cited by examiner

*Primary Examiner*—Hoang Ngo
(74) *Attorney, Agent, or Firm*—Fitzpatrick, Cella, Harper & Scinto

(57) ABSTRACT

In an image forming apparatus having at least one single electrostatic latent image bearing member and a plurality of image forming units each having a replenishing developer cartridge and a developing assembly, at least one of the image forming units is a special-color image forming unit having a special-color replenishing developer cartridge containing a special-color replenishing developer, and at least one of the other image forming unit is a non-special-color image forming unit having a non-special-color replenishing developer cartridge containing a non-special-color replenishing developer. The special-color replenishing developer cartridge has a volume larger than the volume of the non-special-color replenishing developer cartridge, and the special-color replenishing developer contains a toner and a carrier.

26 Claims, 5 Drawing Sheets

IMAGE FORMING APPARATUS, AND REPLENISHING DEVELOPER KIT

BACKGROUND OF THE INVENTION

Field of the Invention

This invention relates to a replenishing developer kit used in an image forming apparatus employing, e.g., an electrophotographic system. More particularly, it relates to an improvement of a color image forming apparatus which has replenishing developer cartridges corresponding to respective colors, holding therein two- or more-color replenishing developers, and in which replenishing developers for respective color components are replenished to respective-color-component developing assemblies set in the main body of the image forming apparatus.

Color image forming apparatus employing, e.g., an electrophotographic system, have been known in which an electrostatic latent image bearing member is disposed in the main body of an image forming apparatus and the circumference of this electrostatic latent image bearing member is provided with latent image forming devices (a charging assembly and an exposure unit) by means of which electrostatic latent images are formed on the electrostatic latent image bearing member, developing assemblies by means of which the electrostatic latent images formed on the electrostatic latent image bearing member are rendered visible with the use of toners to form toner images, a transfer assembly by means of which the electrostatic latent images held on the electrostatic latent image bearing member are transferred onto a recording medium via, or not via, an intermediate transfer member, and a cleaning assembly by means of which the surface of the electrostatic latent image bearing member is cleaned to remove toners remaining thereon.

In the color image-forming apparatus of this type, there are demands from users as follows:

Demand 1: It is requested to enhance only the ability of image formation in a special color, in particular, a special color frequently used (particularly, black).

Demand 2: When setting the replacement of a black-and-white image forming apparatus with a color image-forming apparatus, it is requested to secure the performance the black-and-white image forming apparatus already set has, in other words, secure the black-toner volume corresponding to the volume of black-and-white image formation, to reduce the number of times for the changing of replenishing developer cartridges for new ones, and to elongate the lifetime of developers held in developer chambers of developing assemblies to reduce the number of times for the changing of the developers held in developer chambers of developing assemblies. That is, there is such a demand that, even in replacing the black-and-white image forming apparatus with the color image forming apparatus, the performance that is higher than what has ever been should be secured in regard to the performance of black-and-white image formation.

However, in conventional color image forming apparatus, from the viewpoints of the avoidance of making color image forming apparatus large-sized in respect to black-and-white image forming apparatus and the product management or physical distribution, it has been common that the respective-color-component (e.g., cyan, magenta, yellow and black) replenishing developer cartridges have the same size in all the four colors. Accordingly, for users who frequently use image formation in a special color such as black, such replenishing developer cartridges having the same size for the respective color components is insufficient in the volume of black toner, so that the replenishing developer cartridge for black must be changed at so short intervals as to be inconvenient. In addition, image defects have tended to appear which are caused by the fly-up or scatter of toner that occurs when the replenishing developer cartridge is changed for new one. As a countermeasure for such problems, in Japanese Patent Application Laid-open No. 2001-265088, a color image forming apparatus is proposed in which a replenishing developer cartridge for a special color (e.g., a color frequently used) is made to have a large volume.

However, even though only the toner for a special color frequently used is made to have a large volume, the deterioration of a developer, particularly a carrier, in the developer chamber of a developing assembly does not differ so much from that of developers for non-special colors. Hence, the special-color developer must frequently be changed compared with the non-special-color developers.

Accordingly, when developers are frequently changed, the carrier immediately before change has come to have a vastly lower function than the carrier immediately after change, and it follows that this causes a vast difference in image quality between the carrier immediately before change and the carrier immediately after change. Also, the operation to change developers is troublesome because a used developer is withdrawn from the interior of a developing assembly and a unused developer is put into it, and also image defects tend to appear which are caused by the fly-up or scatter of toner that occurs in the developing assembly when the developer is changed. Moreover, the periodical changing of developers by servicemen or someone else may also lead to a rise in running cost.

Meanwhile, in order to keep developers from deteriorating and to reduce the number of times the developers are replaced, a developing assembly of a system in which the carrier in a developing assembly is little by little replenished (hereinafter often simply "auto-refresh developing system") is proposed, as disclosed in Japanese Patent Publication No. H2-21591 (Japanese Patent Application Laid-Open No. S59-100471) and Japanese Patent Applications Laid-open No. H1-43301, No. H3-145678, No. 2002-328493 and so forth.

More specifically, a unused carrier is little by little replenished from a developer replenishment unit to the developing assembly, and on the other hand the used developer remaining in the developing assembly to become excess as a result of this replenishment is discharged by overflow from a developer-discarding opening and collected in a developer collection container. In such a developing assembly, the chargeability of the developer continues to deteriorate until a certain service time has lapsed after the unused carrier has been filled in the developing assembly, but thereafter becomes stable to come substantially constant as the unused carrier is little by little replenished and the used developer is little by little discharged. Also, the developer collection container may be changed for another after it has become full with the developer collected, and hence the interval at which periodic changes are operated in accordance with the deterioration of the carrier can be longer. As a result, such a developing system, while having a complicate main-body construction, can be a system having such an advantage that, when only the developer collection container is changed, the interior of the image forming apparatus can not easily be contaminated because of the fly-up or scatter of toner. The changes in image quality that occur when developers are changed for new ones can also be kept from occurring. Moreover, the number of times of the periodic change for fresh developers by servicemen or someone else can be lessened, making it possible to reduce running cost.

However, compared with conventional image forming apparatus, the image forming apparatus employing the auto-refresh developing system is enlarged due to the mechanism for discharging the used developer in the developing assembly by overflow from a developer-discarding opening or due to the collection container for the developer discharged, and especially in color image forming apparatus having developing assembles for a plurality of colors, such enlargement comes to be remarkable.

SUMMARY OF THE INVENTION

The present invention has been made in order to solve the above problems.

More specifically, an object of the present invention is to provide an image forming apparatus, and a replenishing developer kit, which can reduce the number of times for the replenishment of developers by means of replenishing developer cartridges and for the changing of developers held in developer chambers of developing assemblies, and can reduce the contamination of the interior of an image forming apparatus, caused by the fly-up or scatter of toner when developers are replenished or changed.

Another object of the present invention is to provide an image forming apparatus, and a replenishing developer kit, which can vastly restrain the deterioration of the developer for a special color to afford stable monochromatic images and high-quality color images over a long period of time.

A still another object of the present invention is to provide an image forming apparatus, and a replenishing developer kit, which can vastly reduce running costs.

That is, the present invention provides an image forming apparatus having at least a single electrostatic latent image bearing member and a cyclic image forming unit group i) which is provided in a circular arrangement with a plurality of image forming units each having a replenishing developer cartridge containing a replenishing developer, and a developing assembly, and forming respective different-color toner images on the electrostatic latent image bearing member and ii) which is so constructed that each image forming unit is rotatively movable to a development position;

an exposure position and a development position at the time of formatting respective-color toner images being the same for each color;

the respective-color toner images formed on the electrostatic latent image bearing member being superimposingly transferred under registration onto a recording medium via, or not via, an intermediate transfer member, and the respective-color toner images formed on the electrostatic latent image bearing member being transferred to the recording medium or the intermediate transfer member at the same transfer position;

at least one of the image forming units being a special-color image forming unit having a special-color replenishing developer cartridge containing a special-color color component replenishing developer, and at least one of the other image forming units being a non-special-color image forming unit having a non-special-color replenishing developer cartridge containing a non-special-color color component replenishing developer other than the special-color color component replenishing developer;

the special-color image forming unit performing image formation by the use of a two-component developer containing a carrier and a toner;

the special-color replenishing developer cartridge having a volume larger than the volume of the non-special-color replenishing developer cartridge; and the special-color color component replenishing developer containing a toner and a carrier.

The present invention also provides a replenishing developer kit having replenishing developer cartridges holding therein replenishing developers, with respect to at least two-color color components;

of the replenishing developer cartridges, a special-color replenishing developer cartridge holding therein a special-color color component replenishing developer having a volume larger than the volume of at least one non-special-color replenishing developer cartridge holding therein a non-special-color color component replenishing developer other than the special-color color component replenishing developer; and the special-color color component replenishing developer containing a toner and a carrier.

The present invention still also provides an image forming apparatus having at least (I) an image forming unit group having i) a plurality of movable image forming units which form respective different-color toner images on a single electrostatic latent image bearing member having a single image formation position constituted of a single exposure position and a single transfer position, the image forming units being disposed in a circular arrangement, and ii) replenishing developer cartridges, and (II) a moving means for rotatively moving the whole image forming unit group in order to move each of the image forming units to the single image formation position in order; different-color toner images being superimposingly transferred under registration onto a recording medium via, or not via, an intermediate transfer member to form a color image, wherein;

the replenishing developer kit constituted as described above is used.

The present invention further provides an image forming apparatus having at least a plurality of electrostatic latent image bearing members and a plurality of image forming units corresponding respectively to the electrostatic latent image bearing members;

the image forming units each having a replenishing developer cartridge containing a replenishing developer, and a developing assembly, and forming respectively different-color toner images on the electrostatic latent image bearing members;

at least one of the image forming units being a special-color image forming unit having a special-color replenishing developer cartridge containing a special-color color component replenishing developer, and at least one of the other image forming units being a non-special-color image forming unit having a non-special-color replenishing developer cartridge containing a non-special-color color component replenishing developer other than the special-color color component replenishing developer;

the special-color image forming unit performing image formation by the use of a two-component developer containing a carrier and a toner;

the special-color replenishing developer cartridge having a volume larger than the volume of the non-special-color replenishing developer cartridge; and the special-color color component replenishing developer containing a toner and a carrier.

The present invention still further provides an image forming apparatus having at least a single electrostatic latent image bearing member and a plurality of image forming units which each have a replenishing developer cartridge containing a replenishing developer, and a developing assembly, and which form respective different-color toner images on the electrostatic latent image bearing member;

at least one of the image forming units being a special-color image forming unit having a special-color replenishing developer cartridge containing a special-color color component replenishing developer, and at least one of the other image forming units being a non-special-color image forming unit having a non-special-color replenishing developer cartridge containing a non-special-color color component replenishing developer other than the special-color color component replenishing developer;

the special-color image forming unit performing image formation by the use of a two-component developer containing a carrier and a toner;

the special-color replenishing developer cartridge having a volume larger than the volume of the non-special-color replenishing developer cartridge; and the special-color color component replenishing developer containing a toner and a carrier.

DESCRIPTION OF THE PREFERRED EMBODIMENTS

In general, even in a color image forming apparatus, a special-color (e.g., black) toner is frequently used alone, and the special-color toner is necessarily consumed in a large quantity. Hence, a special-color replenishing developer cartridge is frequently changed for new one. A special-color developer is also frequently used, and hence it may frequently undergo vibration caused at the time of development or stress coming from agitators, so that the special-color developer in a developing assembly may deteriorate to come to have a vastly short lifetime, and hence, compared with non-special-color developers, the special-color developer in a developing assembly may also come to be frequently changed for new one. Hence, the special-color replenishing developer cartridge and the special-color developer in a developing assembly come to be frequently changed for new ones by a user or serviceman, tending to cause the image defects due to fly-up or scatter of toner. In addition, since the special-color developer is periodically frequently changed for new one by a serviceman or someone else, this results in a rise in running costs. Accordingly, in the color image forming apparatus, it is required that the special-color replenishing developer cartridge and the special-color developer are changed less frequently as in non-special-color replenishing developer cartridges and developers. It is also required to achieve excellent image quality in regard to the special color, and also afford excellent running stability.

Accordingly, in the present invention, taking account of making the main-body apparatus compact and in order to change the special-color replenishing developer cartridge less frequently and allow the special-color developer to have a longer lifetime, the special-color replenishing developer cartridge is made to have a volume larger than that of other-color replenishing developer cartridge, and the special-color developing system is set up as an auto-refresh developing system in which a carrier is incorporated in a replenishing developer so that a unused carrier is little by little replenished, and a used carrier in a developing assembly is little by little discharged. In addition, in the present invention, the system may preferably be so constructed that only the developing system for the special color is the auto-refresh developing system and, in regard to non-special-colors, only toners are replenished.

In the present invention, a developing system making use of a two-component developer containing a carrier and a toner is used as the special-color developing system making use of a special-color image forming unit.

Figure 1:
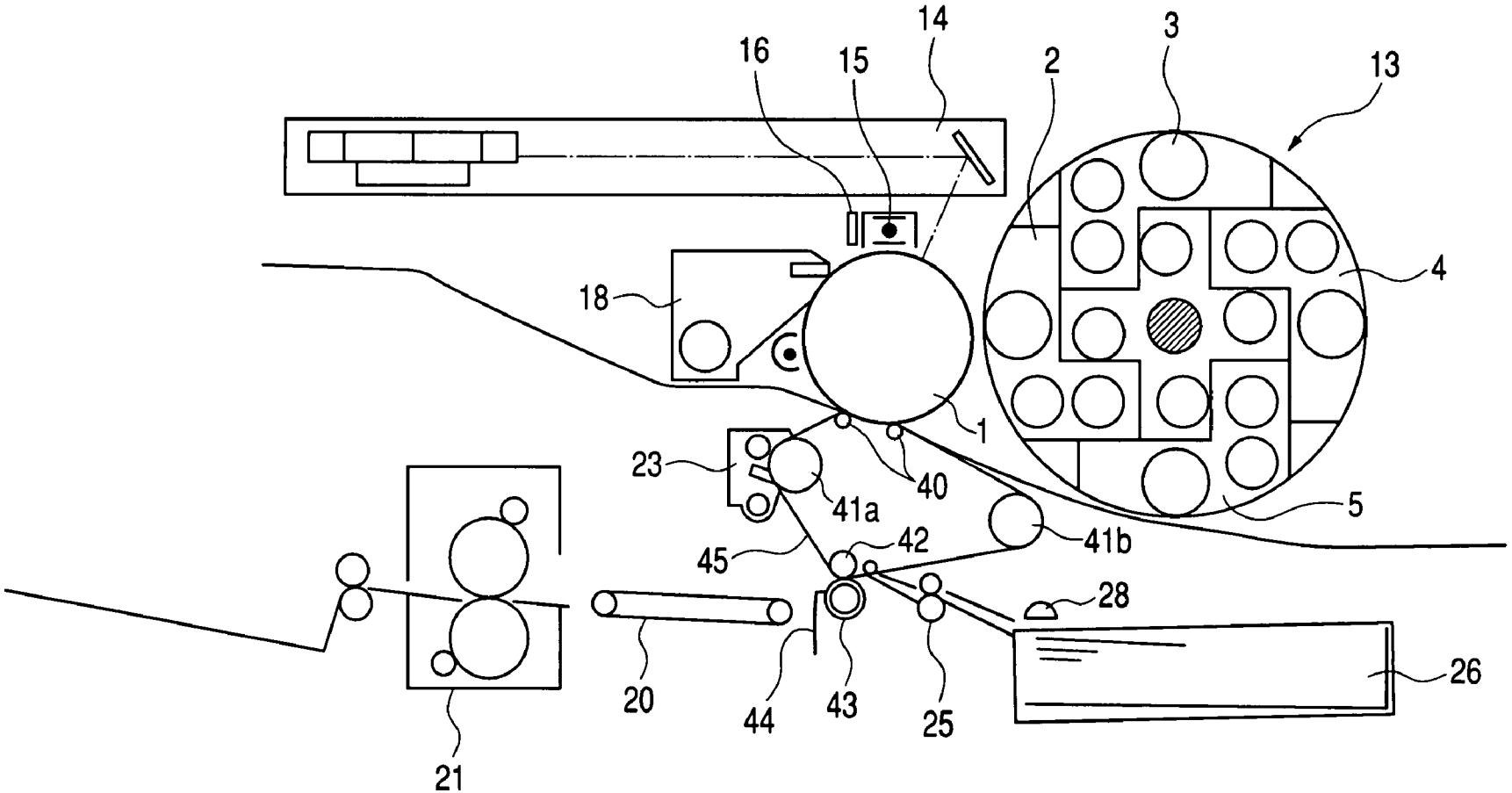
FIG. 1 is a structural view of an image forming apparatus having developing assemblies of a rotary system, in which replenishing developers are used.
Figure 2:
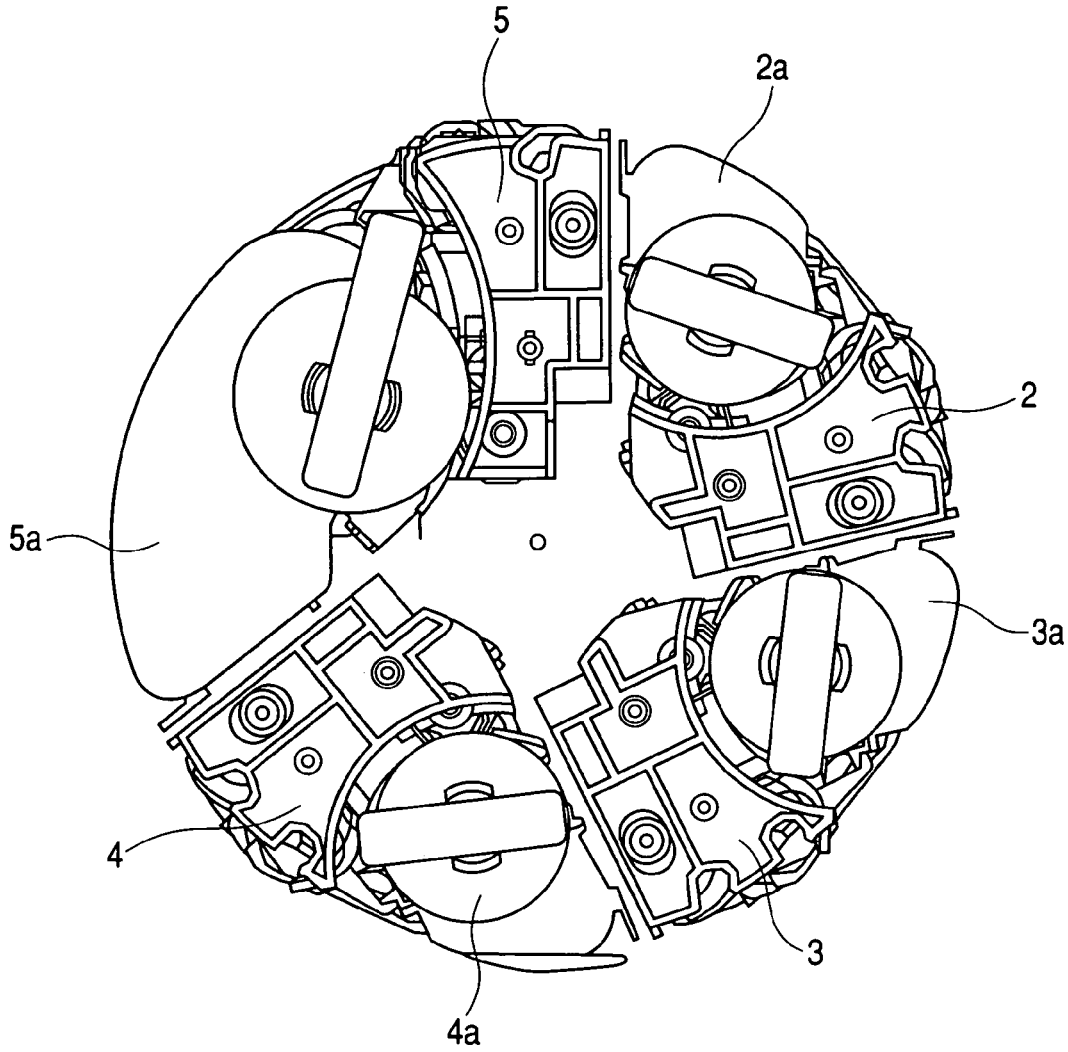
FIG. 2 is a structural view of an image forming unit group 13 shown in FIG. 1.
Figure 3:
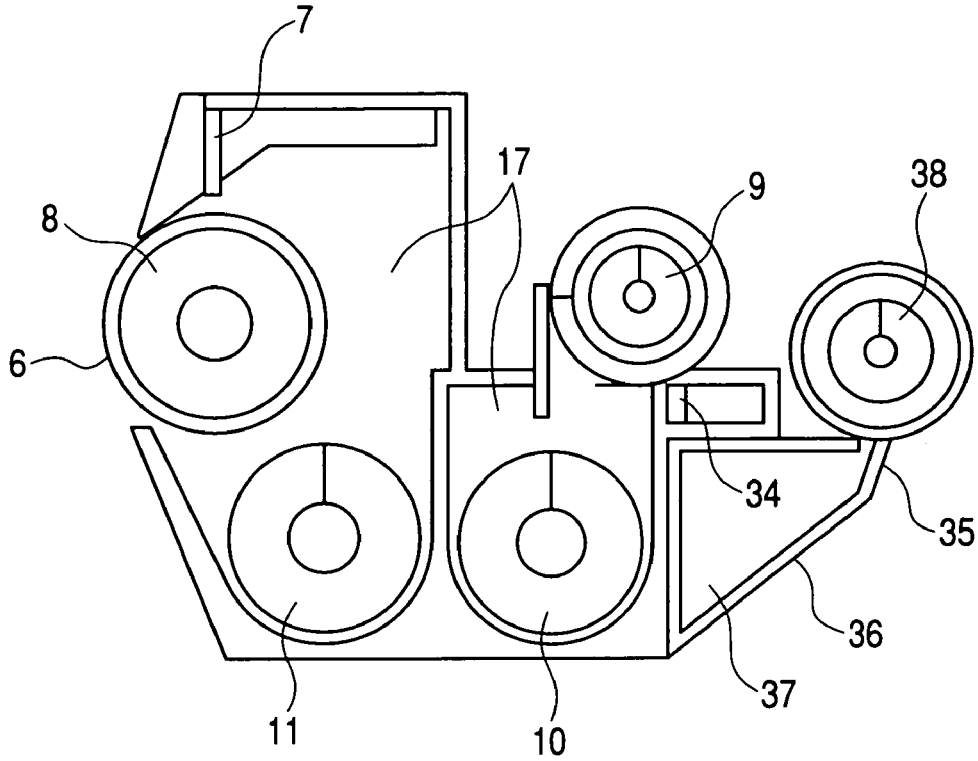
FIG. 3 is a sectional view of a developing assembly shown in FIGS. 1 and 2.

More specifically, the present invention is characterized in that, as shown in FIGS. 1, 2 and 3, in a plurality of replenishing developer cartridges (2*a*, 3*a*, 4*a* and 5*a*) which replenish respective-color component replenishing developers to respective-color component developing assemblies (2, 3, 4 and 5) set in the main body of an image forming apparatus (FIG. 1), the volume of a special-color replenishing developer cartridge 5*a* holding therein a special-color color component replenishing developer frequently used is set larger than the volume of each of non-special-color replenishing developer cartridges (2*a*, 3*a* and 4*a*) holding therein color component replenishing developers other than the special-color color component replenishing developer. The present invention is further characterized in that a carrier is incorporated in the special-color replenishing developer and the auto-refresh developing system is employed as the special-color developing system. In addition, in FIG. 1, reference numeral 1 denotes an electrostatic latent image bearing member on which electrostatic latent images are formed which are to be made into visible images (toner images) by means of a cyclic image forming unit group 13.

In such a technical means, the special color may usually include black, which is frequently used, but may be selected at will according to demands of users.

Here, it is sufficient for the special-color replenishing developer cartridge to have a volume larger than the volume of any of the non-special-color replenishing developer cartridges, and that cartridge may be constituted of a plurality of replenishing developer cartridges or may be a single replenishing developer cartridge having a volume larger than the volume of any of the non-special-color replenishing developer cartridges. As for the non-special-color replenishing developer cartridges, they may preferably have the same size from the viewpoint of the use of common component parts, but may not have the same size.

In the foregoing, the present invention is exemplified by using an image forming apparatus having employed a rotary developing system. Instead, as the image forming apparatus of the present invention, any system may be used in which the volume of the special-color replenishing developer cartridge is larger than the volume of any of the non-special-color replenishing developer cartridges and also the special-color developing system employs the auto-refresh developing system in which a carrier is incorporated in the special-color replenishing developer.

For example, usable are a method in which, around the surface of a cylindrical recording medium holding member provided face to face on a single cylindrical electrostatic latent image bearing member, a recording medium is wound around by electrostatic force or mechanical action of a gripper or the like, and the steps of development and transfer are carried out four times to obtain a color image (a transfer drum system); a method in which four-color toner images are formed on a single electrostatic latent image bearing member, and are collectively transferred to paper (a multiple developing system); and a method in which, using four electrostatic latent image bearing members, electrostatic latent images formed on the respective electrostatic latent image bearing members are developed with the use of, e.g., a yellow developer, a magenta developer, a cyan developer and a black developer, and the respective toner images formed are transferred to a recording medium via, or not via, an intermediate transfer member to form a color image (a tandem system). In particular, the image forming apparatus having employed a rotary developing system has a construction most suited for the materialization of a compact main-body apparatus that is one of what are aimed in the present invention, in a case where only the special-color image forming unit employs the auto-refresh developing system so that the lifetimes of developers in special-color and non-special-color developer chambers can be balanced, and the special-color replenishing developer cartridge has a volume larger than other-color (non-special-color) replenishing developer cartridges.

An example of the image forming apparatus usable in the present invention is described with reference to FIGS. 1, 2 and 3.

FIG. 1 is a schematic structural view of an example of a color image forming apparatus of an electrophotographic system in which the special color is black and the non-special colors are yellow, magenta and cyan; the apparatus having a cyclic image forming unit group 13 of a rotary system and having image forming units (developing assemblies and replenishing developer cartridges involved therewith) for respective colors. An electrostatic latent image bearing member 1 is, at its surface, uniformly electrostatically charged to, e.g., a negative polarity by means of a charging assembly 15. Next, imagewise exposure corresponding to a first-color, e.g., a yellow image is performed by an exposure unit 14, so that an electrostatic latent image corresponding to the yellow image is formed on the surface of the electrostatic latent image bearing member 1.

A schematic structural view of the cyclic image forming unit group 13 is shown as FIG. 2. The cyclic image forming unit group 13 is so constructed as to be rotatively movable by a moving means. Before the leading end of an electrostatic latent image corresponding to the yellow image reaches the development position, a yellow developing assembly comes to face the electrostatic latent image bearing member 1, and thereafter a magnetic brush rubs the electrostatic latent image to form a yellow toner image on the electrostatic latent image bearing member. Here, there are no particular limitations on the moving means as long as it can rotatively move the cyclic image forming unit.

FIG. 3 is a sectional view of each of the developing assemblies shown in FIG. 2. In addition, as to the non-special-color developers 2, 3, 4 not employing the auto-refresh developing system, they have no developer collection function corresponding to members 34 to 38.

Each developing assembly used in development is provided with, as shown in FIG. 3, e.g., a developing sleeve as a developer carrying member, a magnet roller 8, a developer control member 7, developer transport screws 10 and 11, a scraper (not shown) and so forth.

The flow of the developer which is held in the developing assembly and is transported on until it participates in development is described with reference to FIGS. 1, 2 and 3. In this example, both the special-color developer and the non-special-color developers are two-component developers. The developing sleeve 6 is internally provided with the magnet roller 8, which is set stationary, and is rotatively driven keeping a stated development space between it and the peripheral surface of the electrostatic latent image bearing member 1. There may be a case where the developing sleeve 6 and the electrostatic latent image bearing member are kept in contact with each other. The developer control member 7 is a member having rigidity and magnetic properties. The developer control member 7 may include various members such as a member brought into pressure contact with the developing sleeve 6 under application of a stated load in the state the developer does not intervene, and a member provided keeping a stated space between it and the developing sleeve 6. A pair of the developer transport screws 10 and 11 have a screw structure, and act to transport and circulate the developer in the directions opposite to each other, agitate and blend a toner and a carrier sufficiently, and thereafter send them to the developing sleeve 6 as the developer. The magnet roller 8 may also be, e.g., one constituted of a magnet having four poles with the same magnetic force which are north (N) poles and south (S) poles disposed alternately at regular intervals; one constituted of a magnet having six poles; or one in which one pole is deleted from six poles to provide five poles in order to form a repulsive magnetic field at the part coming into contact with the scraper, so as to release the developer therefrom with ease, and the developing sleeve 6 is internally provided with such a magnet roller in a stationary state.

A pair of developer transport screws 10 and 11 in pair are members serving also as agitation members which are rotated in the directions opposite to each other. They transport the replenishing developer replenished from the replenishing developer cartridge (FIG. 2: 2*a*, 3*a*, 4*a* and 5*a* each) by the thrust force of a screw of a replenishing developer holder 9. At the same time, they act to blend the toner and the carrier to afford a homogeneous two-component developer having been charged triboelectrically, and make the two-component developer adhere to the peripheral surface of the developing sleeve 6.

The developer on the surface of the developing sleeve 6 forms a uniform layer by the aid of the developer control member 7 provided facing the magnetic poles of the magnet roller 8. The developer layer formed uniformly develops the latent image formed on the peripheral surface of the electrostatic latent image bearing member 1 to form a toner image.

Then, this toner image is transferred to an intermediate transfer member 45 by means of a transfer unit 40.

Upon completion of the above copy cycle for yellow, the electrostatic latent image bearing member from which the yellow toner image has been transferred is optionally subjected to cleaning pretreatment, and then destaticized by means of a charge elimination unit, where the yellow toner having remained on the surface is scraped off by a cleaning blade of a cleaning unit 18.

Then, the image forming unit group 13 is rotated, and the developing assemblies 3, 4 and 5 are so switched that they face the electrostatic latent image bearing member 1 in order, where, e.g., magenta, cyan and black toner images are transferred to the intermediate transfer member 45 in order, by the same copy cycle as the above.

Upon performance of each of the above copy cycles, the toner images corresponding to the respective color components come transferred to the intermediate transfer member 45 by means of the transfer unit 40 at the same position, so that the toner images corresponding to the respective color components are superimposed to form a complete one color toner image. Meanwhile, recording mediums 12 such as sheets of paper or transparent sheets held in a paper feed tray 26 are sheet by sheet fed to registration rollers 25 by means of a delivery roller 28, and each recording medium 12 is transported to the part between the intermediate transfer member 45 and a transfer roller 43 in synchronization with the rotation of the intermediate transfer member 45. To the recording medium 12 thus transferred, the color toner image on the intermediate transfer member 45 is transferred by means of the transfer roller 43. Thereafter, the recording medium 12 is separated from the intermediate transfer member 45 by means of a separation finger 44, and is led to a fixing assembly 21 by means of a transfer belt 20. Then, the color toner image is fixed to the recording medium 12, and thereafter this recording medium 12 is put out of the apparatus. Thus, a copy mode for one time comes completed. In addition, symbol 16 denotes a pre-exposure device, symbols 41*a* and 41*b* denote a roller for rotating the intermediate transfer member, and symbol 42 denotes an opposition roller provided opposite to the transfer roller.

The intermediate transfer member 45 from which the color toner image has been transferred is also de-charged on its surface by means of a charge elimination unit (not shown), and thereafter its surface is cleaned by a cleaning unit 18 to come standby for the next copy cycle.

With repetition of the above copying motion, the toner in the developer held in a developer chamber 17 inside the developing assembly as shown in FIG. 3 is little by little consumed, and the proportion of the toner to the carrier, i.e., toner concentration come to lower. Changes of this toner concentration are feedback-controlled by a toner concentration sensor (not shown) and/or according to the transition of density of standard images on the electrostatic latent image bearing member and/or the intermediate transfer member so that the toner concentration may always be within the necessary proper range.

Upon the above control, the replenishing developer is sent out of the replenishing developer cartridge to the replenishing developer holder 9, and subsequently the replenishing developer is fed from the replenishing developer holder 9 through its replenishment opening by the thrust force of a screw, to the developer chamber 17 inside the developing assembly.

In the black developing assembly 5, which employs the auto-refresh developing system, the replenishing developer in which the toner and the carrier have been blended according to the present invention is replenished from the replenishing developer cartridge 5*a* to the black developing assembly 5 through the replenishment opening of the replenishing developer holder 9.

The excessive developer is discharged from the black developing assembly 5 by utilizing the rotary movement in the rotary-movable cyclic image forming unit group 13 shown in FIG. 1. How it is discharged is described below with reference to FIGS. 2 and 3.

In the color image forming apparatus having the image forming unit group 13 which has rotary developing units having employed a rotary movement system, the developing assemblies 2, 3, 4 and 5 are rotatively moved in the interior of the image forming unit group 13. At the time of development, they are rotatively moved to the position facing the electrostatic latent image bearing member 1. At the time of non-development, they are rotatively moved to the position not facing the electrostatic latent image bearing member 1.

At the position where the developing assembly 5 faces the electrostatic latent image bearing member and performs development motion, the excessive developer (with the carrier having deteriorated) is overflowed from a developer-discarding opening 34, is overflowed from a developer-discarding opening 34, is moved through the interior of a developer collection auger 36 by rotational motion, and is discharged to a developer collection container (not shown) provided on the rotating shaft of the image forming unit group 13 of a rotary system. Instead, also available is a method in which the developer is collected in the developer collection container without providing the developer collection auger, or a method in which the developer collection container is provided not on the rotating shaft of the image forming unit group 13 but in, e.g., the replenishing developer cartridge.

As a method of development in the present invention, stated specifically, the development may preferably be performed while applying an AC voltage to the developing sleeve to form an alternating electric field at the developing zone and in such a state that a magnetic brush comes into touch with the electrostatic image bearing member. A distance between the developing sleeve 6 and the electrostatic image bearing member 1 (S–D distance) may preferably be from 100 to 800 μm. This is favorable for preventing carrier adhesion and improving dot reproducibility. If it is smaller than 100 μm, the developer tends to be insufficiently fed, resulting in a low image density. If it is larger than 800 μm, the magnetic line of force from a magnet pole may broaden to make the magnetic brush have a low density, resulting in a poor dot reproducibility, or to weaken the force of binding the carrier, tending to cause carrier adhesion.

The alternating electric field may preferably be applied at a peak-to-peak voltage of from 300 to 3,000 V and a frequency of from 500 to 10,000 Hz, which may each be applied under appropriate selection in accordance with processes. In this instance, the waveform used may include a triangular waveform, a rectangular waveform, a sinusoidal waveform, or a waveform with a varied duty ratio. In particular, in order to deal with changes in toner image formation speed, the development may preferably be performed in the state a development bias voltage having discontinuous AC bias voltage (an intermittent alternating superimposed voltage) is applied to the developing sleeve. If the applied voltage is lower than 300 V, a sufficient image density may be difficult to attain, and fog toner at non-image areas can not be well collected in some cases. If it is higher than 3,000 V, the latent image may be disordered through the magnetic brush to cause a lowering of image quality in some cases.

Use of a two-component developer having a toner well charged enables a low defogging voltage (Vback) to be applied, and enables the primary charging of the electrostatic latent image bearing member to be lowered, thus the electrostatic latent image bearing member can be made to have a longer lifetime. The Vback, which may depend on the developing system, may preferably be 200 V or below, and more preferably 150 V or below. As a contrast potential, a potential of from 100 V to 400 V may preferably be used so that a sufficient image density can be achieved.

If the frequency is lower than 500 Hz, the toner having come into contact with the electrostatic image bearing member can not well be vibrated when returned to the developing sleeve, so that fog tends to occur. If it is higher than 10,000 Hz, the toner can not follow the electric field to tend to cause a lowering of image quality.

The following is important in the developing method in the present invention: In order to perform development ensuring a sufficient image density, achieving a superior dot reproducibility and free of carrier adhesion, the magnetic brush on the developing sleeve 6 may preferably be made to come into touch with the electrostatic image bearing member 1 at a width (developing nip) of from 3 to 8 mm. If the developing nip is narrower than 3 mm, it may be difficult to well satisfy sufficient image density and dot reproducibility. If it is broader than 8 mm, the developer may pack into the nip to cause the machine to stop from operating, or it may be difficult to well prevent the carrier adhesion.

As methods for adjusting the developing nip, a method is available in which the nip width is appropriately adjusted by adjusting the distance between the developer control member 7 and the developing sleeve 6, or by adjusting the distance between the developing sleeve 6 and the electrostatic latent image bearing member 1 (S–D distance).

The electrostatic latent image bearing member may have the same construction as electrostatic latent image bearing members used in conventional image forming apparatus. For example, it may include a photosensitive member having construction in which a conductive substrate made of aluminum, SUS stainless steel or the like is provided thereon with a conductive layer, a subbing layer, a charge generation layer, a charge transport layer, and optionally a charge injection layer in this order. The conductive layer, the subbing layer, the charge generation layer and the charge transport layer may be those used in conventional photosensitive members. As an outermost surface layer of the photosensitive member, the charge injection layer or a protective layer may be used, for example.

Figure 6:
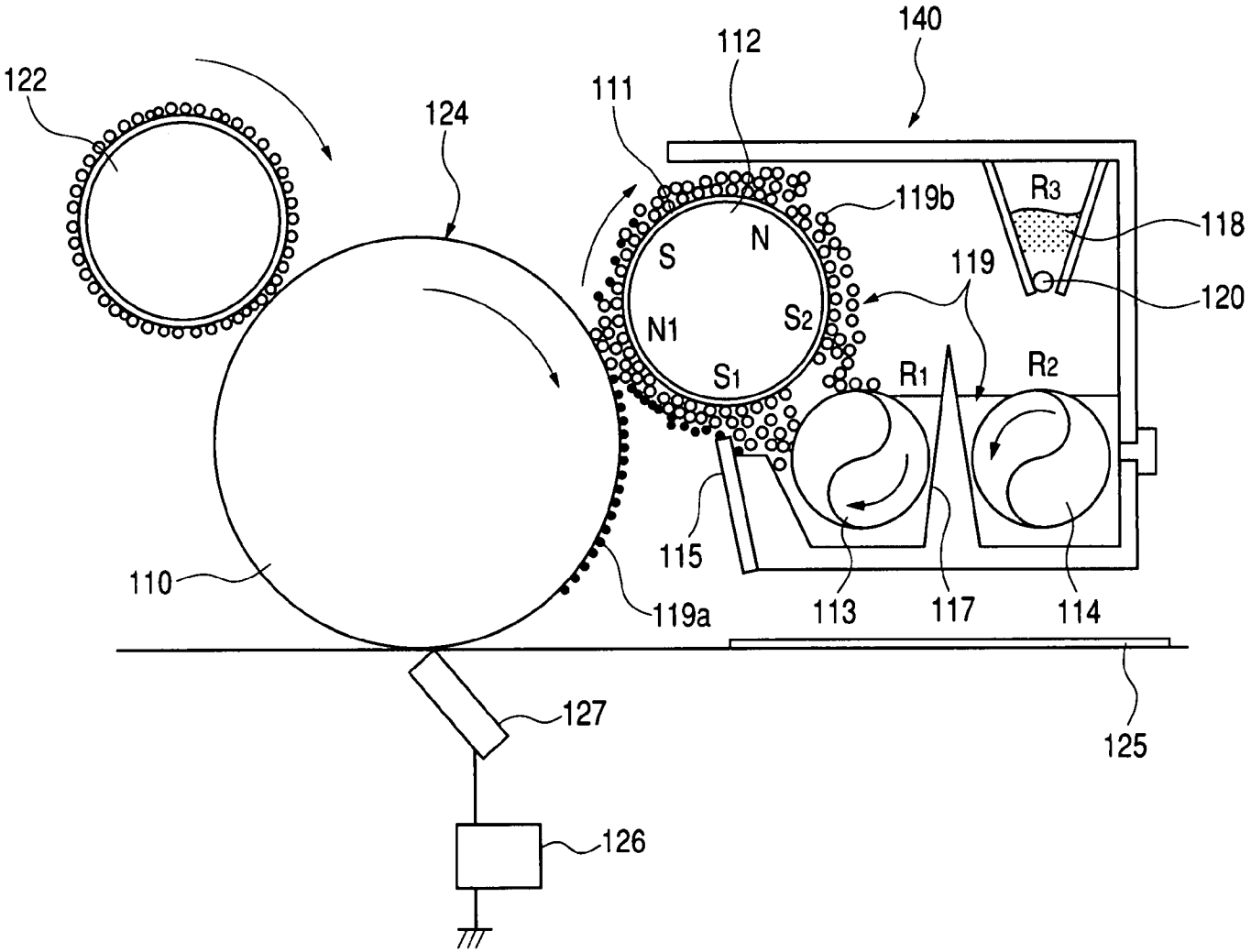
FIG. 6 is a sectional view of a developing assembly used in a cleanerless system.

An example in which a cleanerless system is applied to the image forming apparatus of the auto-refresh developing system is described with reference to FIG. 6.

A charging roller 122 is brought into contact with the surface of an electrostatic latent image bearing member 110 to charge the electrostatic latent image bearing member 110 electrostatically. A charging bias is kept applied to the charging roller 122 by a bias applying means (not shown). The electrostatic latent image bearing member 110 thus charged is exposed to laser light 124 by means of an exposure unit (not shown) to form a digital electrostatic latent image. The electrostatic latent image thus formed on the electrostatic latent image bearing member 110 is developed with a toner 119*a* held in a two-component developer 119 and carried on a developing sleeve 111 internally provided with a magnet roller 112 and to which a development bias is kept applied by a bias applying means (not shown).

The inside of a developing assembly 140 is partitioned into a developer chamber R1 and an agitator chamber R2 by a partition wall 117, and is provided with developer transport screws 113 and 114, respectively. At the upper part of the agitator chamber R2, a replenishing developer holding chamber R3 holding a replenishing developer 118 is provided. At the lower part of the replenishing developer holding chamber R3, a replenishing developer supply opening 120 is provided.

As the developer transport screw 113 is rotated, the developer held in the developer chamber R1 is transported in the longitudinal direction of the developing sleeve 111 while being agitated. The partition wall 117 is provided with openings (not shown) on this side and the inner side as viewed in the drawing. The developer transported to one side of the developer chamber R1 by the screw 113 is sent into the agitator chamber R2 through the opening on the same side of the partition wall 117, and is delivered to the developer transport screw 114. The screw 114 is rotated in the direction opposite to the screw 113. Thus, while the developer in the agitator chamber R2, the developer delivered from the developer chamber R1 and the replenishing developer replenished from the replenishing developer holding chamber R3 are agitated and blended, the developer is transported through the interior of the agitator chamber R2 in the direction opposite to the screw 114 and is sent into the developer chamber R1 through the opening on the other side of the partition wall 117.

To develop the electrostatic latent image formed on the electrostatic latent image bearing member 110, the developer 119 held in the developer chamber R1 is drawn by the magnetic force of the magnet roller 112, and is carried on the surface of the developing sleeve 111.

The developer carried on the surface of the developing sleeve 111 is transported to a developer control member 115 as the developing sleeve 111 is rotated, where the developer is controlled into a developer thin layer with a proper layer thickness. Thereafter, it reaches a developing zone where the developing sleeve 111 faces the electrostatic latent image bearing member 110. In the magnet roller 112 at its part corresponding to the developing zone, a magnetic pole (development pole) N1 is positioned, and the development pole N1 forms a development magnetic field at the developing zone. This development magnetic field causes ears of the developer to rise, thus the magnetic brush of the developer is formed in the developing zone. Then, the magnetic brush comes into touch with the electrostatic latent image bearing member 110. The toner attracted to the magnetic brush and the toner attracted to the surface of the developing sleeve 111 are moved and attracted to the region of the electrostatic latent image on the electrostatic latent image bearing member 110, where the electrostatic latent image is developed by reverse development, thus a toner image is formed.

The developer having passed through the developing zone is returned into the developing assembly 140 as the developing sleeve 111 is rotated, then stripped off the developing sleeve 111 by a screw 113, and dropped into the developer chamber R1 and agitator chamber R2 so as to be collected there.

Once a T/C ratio (blend ratio of toner and carrier) of the developer in the developing assembly 140 has lowered as a result of the above development, the replenishing developer 118 is replenished from the replenishing developer holding chamber R3 in the quantity corresponding to the quantity of the developer consumed by the development, thus the T/C ratio of the developer is maintained at a prescribed value. To detect the T/C ratio of the developer 119 in the developing assembly 140, a toner concentration detecting sensor (not shown) is used which measures changes in permeability of the developer by utilizing the inductance of a coil. The toner concentration detecting sensor has a coil (not shown) on its inside.

The developer control member 115, which is provided beneath the developing sleeve 111 to control the layer thickness of the developer 119 on the developing sleeve 111, may include a non-magnetic blade 115 made of a non-magnetic material such as aluminum or SUS316 stainless steel. The distance between the end of the developer control member 115 and the face of the developing sleeve 111 may preferably be 150 to 800 μm, and particularly preferably 160 to 600 μm. If this distance is smaller than 150 μm, the carrier may be difficult to apply between them to tend to make the developing layer non-uniform, and also the developer necessary for performing good development may be difficult to apply on the sleeve, so that developed images with a low density and much non-uniformity tend to be formed. In order to prevent non-uniform coating (what is called the blade clog) due to unauthorized particles included in the developer, the distance may preferably be 150 μm or more. If it is more than 800 μm, the quantity of the developer applied on the developing sleeve 111 increases to make it difficult to desirably control the developer layer thickness, so that the carrier may adhere to the electrostatic latent image bearing member 110 in a large quantity and also the circulation of the developer and the control of the developer by the developer control member 115 may become less effective to tend to cause fog because of a decrease in triboelectricity of the toner.

This magnetic carrier layer, even when the developing sleeve 111 is rotatively driven in the direction of an arrow, moves slower as it separates from the sleeve surface in accordance with the balance between the binding force exerted by magnetic force and gravity and the transport force acting toward the movement direction of the developing sleeve 111. The carrier drops by the effect of gravity.

The toner image formed by development is also transferred onto a transfer medium (recording medium) 125 transported to a transfer zone, by means of a transfer blade 127 which is a transfer means to which a transfer bias is kept applied by a bias applying means 126. The toner image thus transferred onto the transfer medium is fixed to the transfer medium by means of a fixing assembly (not shown). Transfer residual toner remaining on the electrostatic latent image bearing member 110 without being transferred to the transfer medium in the transfer step is charge-controlled in the charging step and collected at the time of development.

Figure 5:
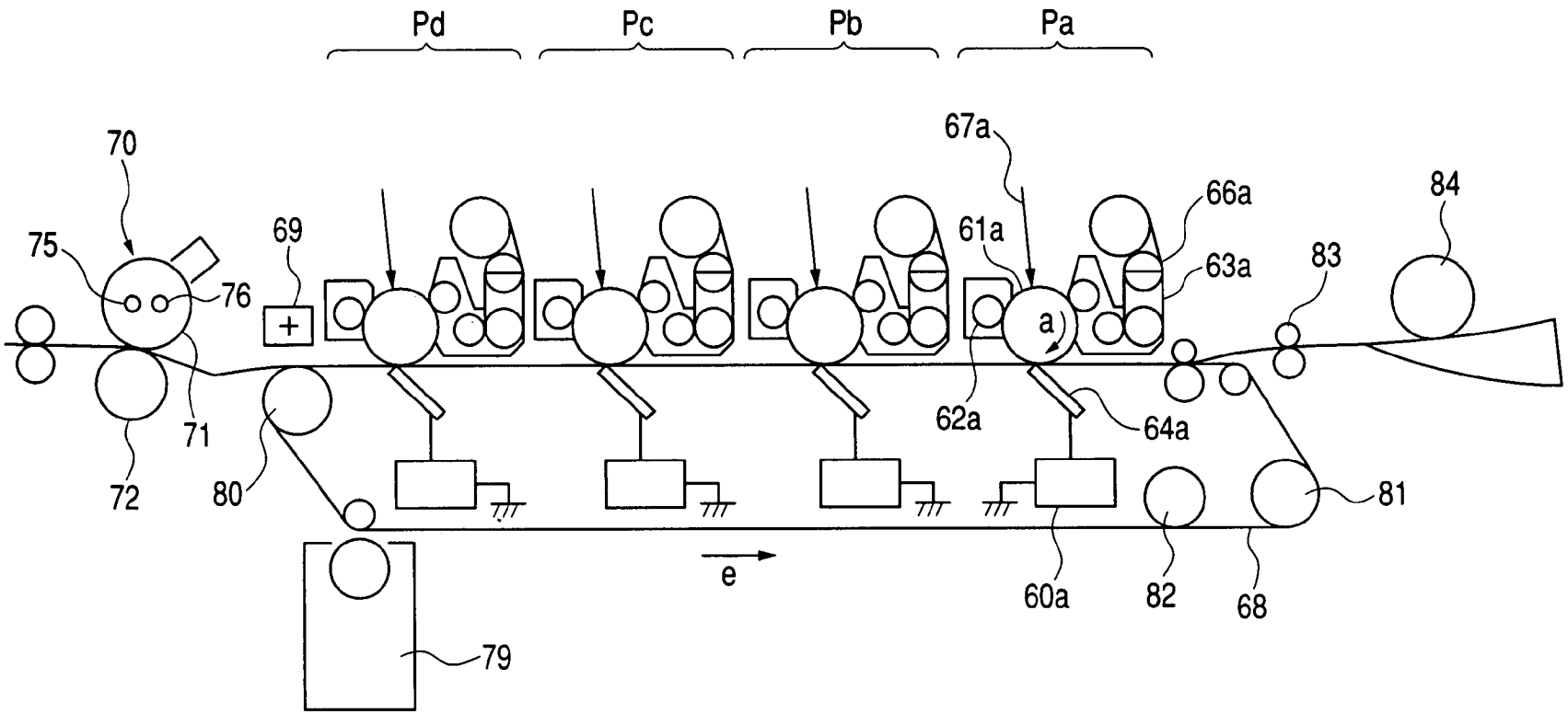
FIG. 5 is a structural view of an image forming apparatus of a tandem system.

FIG. 5 is a schematic view of a full-color image forming apparatus of a tandem system, to which the image forming apparatus and replenishing developer kit of the present invention are applicable.

The full-color image forming apparatus shown in FIG. 5 is an apparatus having no independent cleaning means for collecting and keeping therein the transfer residual toner having remained on the electrostatic latent image bearing member, and having employed a cleaning-at-development system in which a developing means collects the toner having remained on the electrostatic latent image bearing member after toner images have been transferred to the transfer medium. In FIG. 5, an image forming apparatus is exemplified which has employed such a cleaning-at-development system. Instead, it may be an apparatus making use of a cleaning means such as a cleaning blade.

The main body of the full-color image forming apparatus is provided side by side with a first image forming unit Pa, a second image forming unit Pb, a third image forming unit Pc and a fourth image forming unit Pd which each have the construction of a cleanerless system. Only the unit Pb is an image forming unit making use of the auto-refresh developing system, and has, like the developing assembly shown in FIG. 3, a developer collection section 34 to 38. In the units Pa to Pd, images with respectively different colors are formed on a transfer medium through the process of latent image formation, development and transfer.

The respective image forming units provided side by side in the image forming apparatus are each constituted as described below taking the case of the first image forming unit Pa.

The first image forming unit Pa has an electrostatic latent image bearing member 61*a* of 30 mm in diameter. This electrostatic latent image bearing member 61*a* is rotatively moved in the direction of an arrow a. A primary charging assembly 62*a* as a charging means is so provided that a charging magnetic brush formed on a sleeve of 16 mm in diameter comes into contact with the surface of the electrostatic latent image bearing member 61*a*. Laser light 67*a* is emitted by an exposure unit (not shown) in order to form an electrostatic latent image on the electrostatic latent image bearing member 61*a* whose surface has uniformly been charged by means of the primary charging assembly 62*a*. A developing assembly 63*a* holds a color toner thereon, as a developing means for developing the electrostatic latent image held on the electrostatic latent image bearing member 61*a*, to form a color toner image.

A transfer blade 64*a* as a transfer means transfers the color toner image formed on the surface of the electrostatic latent image bearing member 61*a*, to the surface of a transfer medium (recording medium) transported by a belt-like transfer medium carrying member 68. This transfer blade 64*a* comes into touch with the back of the transfer medium carrying member 68 and can apply a transfer bias. In addition, reference numeral 60*a* denotes a bias applying means.

In this first image forming unit Pa, the electrostatic latent image bearing member 61*a* is uniformly primarily charged by the primary charging assembly 62*a*, and thereafter the electrostatic latent image is formed on the electrostatic latent image bearing member by the exposure unit. The electrostatic latent image is developed by the developing assembly 63*a* using a color toner. The toner image thus formed by development is transferred to the surface of the transfer medium by applying a transfer bias from the transfer blade 64*a* coming into touch with the back of the belt-like transfer medium carrying member 68 carrying and transporting the transfer medium, at a first transfer zone (the position where the electrostatic latent image bearing member and the transfer medium come into contact).

The toner is consumed as a result of the development and the T/C ratio lowers, whereupon this lowering is detected by a toner concentration detecting sensor (not shown) which measures changes in permeability of the developer by utilizing the inductance of a coil, and a replenishing developer is sent out to a replenishing developer holder 66*a* in accordance with the quantity of the toner consumed and by a delivery means of a replenishing developer holding container, and then the replenishing developer is fed from the replenishing developer holder 66*a* through its replenishing opening by the action of thrust force of a screw thereof, to the developer chamber in the developing assembly. The toner concentration detecting sensor (not shown) has a coil on its inside.

The image forming apparatus also has the second image forming unit Pb, third image forming unit Pc and fourth image forming unit Pd which are each constituted in the same way as the first image forming unit Pa but having different color toners held in the developing assemblies. Thus, four image forming units are provided side by side.

For example, a yellow toner is used in the first image forming unit Pa, a magenta toner in the second image forming unit Pb, a cyan toner in the third image forming unit Pc and a black toner in the fourth image forming unit Pd making use of the auto-refresh developing system, and the respective-color toners are transferred to the transfer medium in order, at the transfer zones of the respective image forming units.

In this course, the respective-color toners are superimposed while making registration, on the same transfer medium during one-time movement of the transfer medium. After the transfer is completed, the transfer medium is separated from the surface of the transfer medium carrying member 68 by a separation charging assembly 69, and then sent to a fixing assembly 70 by a transport means such as a transport belt, where a final full-color image is formed by only-one-time fixing.

The fixing assembly 70 has a pair of a 40 mm diameter fixing roller 71 and a 30 mm diameter pressure roller 72. The fixing roller 71 has heating means 75 and 76 on its inside.

The unfixed color toner images transferred onto the transfer medium are passed through the pressure contact zone between the fixing roller 71 and the pressure roller 72 of this fixing assembly 70, whereupon they are fixed onto the transfer medium by the action of heat and pressure.

In the apparatus shown in FIG. 5, the transfer medium carrying member 68 is an endless belt-like member. This belt-like member is moved in the direction of an arrow e by a drive roller 80. Besides, the apparatus has a transfer belt cleaning device 79, a belt driven roller 81 and a belt charge eliminator 82. A paper feed roller 84 and a pair of registration rollers 83 are also used to transport the transfer medium from a transfer medium holder to the transfer medium carrying member 68.

As the transfer means, in place of the transfer blade coming into touch with the back of the transfer medium carrying member, a contact transfer means may be used which comes into contact with the back of the transfer medium carrying member and can directly apply a transfer bias, as exemplified by a roller type transfer roller.

In place of the above contact transfer means, a non-contact transfer means may further be used which performs transfer by applying a transfer bias from a corona charging assembly provided in non-contact with the back of the transfer medium carrying member, as commonly used. However, in view of the advantage that the quantity of ozone generated when the transfer bias is applied can be controlled, it is more preferable to use the contact transfer means.

By the use of the replenishing developer according to the present invention, the developer undergoes less shear in the developing assembly, and the incorporation of spent toner or external additive into carrier can be controlled even in many-sheet copying. In addition, the present invention can exhibit such an effect that, even when the carrier is replenished in a small quantity from the replenishing developer for the auto-refresh developing system, image quality can be kept from lowering.

The replenishing developer and two-component developer of the present invention are described below.

In the present invention, where the toner and the carrier are blended to prepare the special-color replenishing developer, the carrier and the toner may preferably be in such a mixing proportion that the toner is in an amount of from 1 to 30 parts by weight based on 1 part by weight of the carrier. As long as they are in a proportion within this range, the charge-providing ability of the carrier in the developer chamber can be made stable in a good efficiency.

Where the toner and the carrier are blended to prepare the two-component developer held in the developer chamber, good results are obtained when they are in such a mixing proportion that the toner is in a concentration of from 2 to 15% by weight, and preferably from 4 to 13% by weight. If the toner is in a concentration of less than 2% by weight, image density tends to lower. If it is in a concentration of more than 15% by weight, fog or in-machine toner scatter tends to occur, and the running lifetime of the developer also tends to lower.

As the carrier used in the present invention, in the replenishing developer for the auto-refresh developing system containing the carrier, the dispersibility of carrier in the replenishing developer holding container should be improved and/or the carrier should be prevented from segregation. For such purposes, it is preferable to control the true specific gravity of the carrier in such a way that the toner and the carrier may have a small difference in specific gravity between them. That is, the carrier used in the replenishing developer may have a true specific gravity of from 2.5 to 4.5 g/cm$^3$, and preferably from 2.8 to 4.0 g/cm$^3$.

If the carrier has a true specific gravity of more than 4.5 g/cm$^3$, the carrier may be difficult to uniformly disperse in the replenishing developer when the toner and the carrier are blended, or, even if it has been dispersed, it tends to segregate at the time of sieving or filling. Moreover, even if the replenishing developer has been filled in the replenishing developer cartridge, where a vibration has acted on the replenishing developer cartridge during its transportation, the carrier tends to segregate because of the difference in specific gravity from the toner, as being caused by a drive means for the rotation or the like for sending the replenishing developer out of the container or a drive means especially for the rotary motion of the image forming apparatus used preferably according to the present invention.

Figure 4:
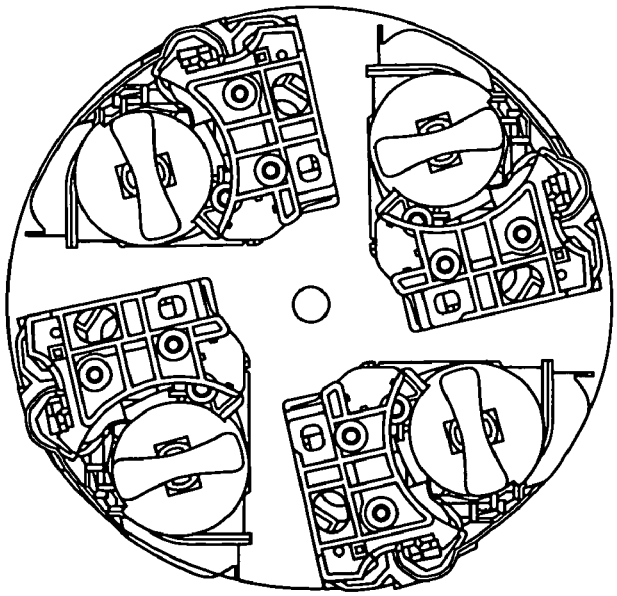
FIG. 4 is a structural view of a cyclic image forming unit group in a case where, in FIG. 1, replenishing developer cartridges have the same volume and their developing assemblies are disposed in regular disposition.

In addition, in the image forming apparatus having employed the rotary developing system preferably used in the present invention, when the volume of the special-color replenishing developer cartridge is so set as to be larger than the non-special-color replenishing developer cartridge(s), inevitably, the image forming units in the image forming unit group are not disposed at a regular interval (e.g., the construction shown in FIG. 2). Hence, when the image forming unit group is rotated in rotary motion, the distance of peripheral movement of the special-color image forming unit is longer than that of the non-special-color image forming unit(s). Thus, compared with the case of regular disposition (e.g., the construction shown in FIG. 4), the way of receiving centrifugal force in respect to the special-color replenishing developer comes one-sided. In such a case, if the carrier has a true specific gravity of more than 4.5 g/cm$^3$, the segregation of the carrier in the replenishing developer tends to come about.

If the carrier has a true specific gravity of less than 2.5 g/cm$^3$, such a condition is achieved by incorporating a magnetic material in the carrier in a small proportion, and hence a weak magnetic binding force may result to tend to cause carrier adhesion or the like to the electrostatic latent image bearing member.

Moreover, since the carrier as described above has an appropriately small true specific gravity, it can restrain a stress to the toner. It may also apply a small load on the developer when the developer is layered on the developing sleeve in a stated thickness by means of the developer layer thickness control member (developer control blade) or when the developer is agitated in the developing assembly. Hence, in using the developer over a long period of time, the carrier and the toner do not easily deteriorate, and hence do not easily lower their developing performances, such as toner scatter or the like. This is the best for the auto-refresh developing system.

The carrier used in the present invention may have a volume-average particle diameter (D50) of from 15 μm to 60 μm, and more preferably from 20 μm to 45 μm. This can allow the present invention to preferably exhibit the meritorious effects. If it has a volume-average particle diameter of more than 60 μm, it may insufficiently provide the toner with uniform and good charges, not only making it difficult to reproduce latent images faithfully, but also causing fog or toner scatter. If on the other hand it has a volume-average particle diameter of less than 15 μm, the carrier may seriously adhere to the electrostatic latent image bearing member.

As the carrier used in the present invention, usable are particles of, e.g., an acidic metal such as surface-oxidized or -unoxidized iron, nickel, copper, zinc, cobalt, manganese, chromium or rare earth elements, or an alloy or oxide thereof, and ferrite; or a magnetic-fine-particle-dispersed resin carrier composed of a binder resin, a metal oxide, a magnetic metal oxide and so forth.

The carrier used in the present invention may be one surface-coated with a resin and/or a coupling agent. This is preferable in order to provide the carrier with charge stability and environmental stability.

As the carrier used in the present invention, a light-metal-containing ferrite carrier or the magnetic-fine-particle-dispersed resin carrier may preferably be used for the following reasons. Ferrite carrier particles not containing any light metal, composed of Cu—Zn, Ni—Zn or the like, which are used in conventional carriers have a true specific gravity of about 4.9 g/cm$^3$. Accordingly, it is preferable to make the carrier have a true specific gravity of 4.5 g/cm$^3$ or less by devising its coating structure. On the other hand, the light-metal-containing ferrite carrier or the magnetic-fine-particle-dispersed resin carrier can arbitrarily be made to have a small true specific gravity, compared with ferrite carriers containing a heavy metal, and may preferably be used as the carrier used in the present invention. In particular, the magnetic-fine-particle-dispersed resin carrier is preferred in view of advantages that its magnetic properties and gravity can arbitrarily be controlled, its particles have less strain coming from their shape, a sharp particle size distribution can be achieved, spherical particles having high particle strength can be formed relatively with ease, and the carrier has superior fluidity and also can be sent well out of the developer chamber.

The magnetic-fine-particle-dispersed resin carrier, which is produced by polymerization, also has a small void volume in virtue of its particle shape and particle size distribution, and hence such a carrier is preferred because the volume of the replenishing developer cartridge can be made small and the image forming apparatus can be easily made compact. Its particle size and resistance can also be controlled over a broad range, and hence it is suited for high-speed copying machines and high-speed laser beam printers in which developing sleeves and magnets in sleeves have a large number of revolutions.

It is further preferable for the magnetic-fine-particle-dispersed resin carrier to be incorporated with a non-magnetic metal oxide and magnetite.

Measurement of True Specific Gravity of Carrier:

The true specific gravity of the carrier in the present invention is measured with TRUE DENSER (manufactured by Seishin Kigyo K.K.) according to JIS Z-2504.

Measurement of Particle Diameter of Carrier:

The volume-average particle diameter (D50) of the carrier is measured with a laser diffraction particle size distribution measuring device HELOS (manufactured by Nippon Denshi K.K.) under the conditions of a feed air pressure of 3 bars and a suction pressure of 0.1 bars.

Where the above physical properties of the carrier are measured from the replenishing developer and two-component developer, the developer is washed with ion-exchanged water containing 1% of CONTAMINON N (a surface-active agent available from Wako Pure Chemical Industries, Ltd.) to separate the toner and the carrier, and thereafter the above measurement is carried out.

The toners used in the present invention are described below.

First, for the toner contained in the special-color color component replenishing developer (hereinafter "special-color toner"), it is important to take account of the following points.

(1) The toner must be made to have a high fluidity in order to keep the carrier from segregating in the replenishing developer holding container and to keep the toner concentration from changing when the toner and carrier are replenished into the developer chamber.

(2) The toner should have a small difference between charge quantity provided by a deteriorated carrier and charge quantity provided by a fresh carrier.

On the other hand, for the toner contained in the non-special-color color component replenishing developer (hereinafter "non-special-color toner"), it is important to take account of the following point.

(3) In the toner of the developer not making use of the auto-refresh developing system, the addition of an external additive in excess lowers carrier's charge-providing ability seriously, because of the accumulation of the external additive.

As a result of extensive studies made taking account of the above (1) to (3), the present inventors have discovered that, in order to form good images, it is effective for an external additive of the special-color toner to be in a larger surface coverage (on toner particles) than the non-special-color toner and for the special-color toner to have a larger weight-average particle diameter than the non-special-color toner.

The surface coverage of an external additive of the toner (the extent to which toner particles are surface-covered with an external additive of the toner) in the present invention is defined as the value found by calculation according to the following expression.

(Surface coverage of external additive of toner)= (total parts by weight of external additive added, based on 100 parts by weight of toner particles)/*St*

(St(=6/(D4·ρt)): specific surface area per unit volume calculated from weight-average particle diameter (D4) measured assuming toner particles to be true spheres; ρt: true specific gravity of toner particles)

In addition, the true specific gravity of the toner in the present invention is measured with TRUE DENSER (manufactured by Seishin Kigyo K.K.) according to JIS Z-2504.

The surface coverage of an external additive of the special-color toner may preferably be larger by 0.05 to 2.0, and more preferably larger by 0.1 to 1.5, than the surface coverage of an external additive of the non-special-color toner.

If a difference in the surface coverage is larger than 2.0, it tends to bring about a large difference in agglomeration properties of the toners, resulting in a large difference in transfer performance to tend to cause image defects due to toner scatter in transfer or due to transfer non-uniformity. If a difference in the surface coverage is smaller than 0.05, it may be difficult to satisfy all the above requirements (1) to (3), making it difficult to achieve what are aimed in the present invention.

The surface coverage of an external additive of the special-color toner may preferably be from 0.5 to 3.5, and more preferably from 0.8 to 2.0.

If the surface coverage of an external additive of the special-color toner is larger than 3.5, some external additive liberated from toner particles tends to accumulate in the developer chamber when the toner is used over a long period of time, so that, even in the auto-refresh developing system, the carrier particle surfaces may be contaminated with the external additive to make it unable to maintain preferable charging performance, tending to cause image defects. Moreover, the external additive liberated tends to fly on the electrostatic latent image bearing member surface at the time of development, also tending to cause melt adhesion of external additive to, or faulty cleaning on, the electrostatic latent image bearing member.

If the surface coverage of an external additive of the special-color toner is smaller than 0.5, the toner may have too low fluidity to satisfy the above requirements (1) and (2).

The external additive of the special-color toner may preferably be added in an amount, which is preferable in the present invention, of from 0.2 to 5 parts by weight, more preferably from 0.3 to 3 parts by weight, and still more preferably from 0.5 to 2 parts by weight, based on 100 parts by weight of the toner particles.

If the external additive of the special-color toner is added in an amount of less than 0.2 part by weight, the toner may have too low fluidity to satisfy the above requirements (1) and (2).

If on the other hand the external additive of the special-color toner is added in an amount of more than 5 parts by weight, some external additive liberated from toner particles tends to accumulate in the developer chamber when the toner is used over a long period of time, so that, even in the auto-refresh developing system, the carrier particle surfaces may be contaminated with the external additive to make it unable to maintain preferable charging performance, tending to cause image defects. Moreover, the external additive having come liberated tends to fly on the electrostatic latent image bearing member surface at the time of development, also tending to cause melt adhesion of external additive to, or faulty cleaning on, the electrostatic latent image bearing member.

Meanwhile, the external additive of the non-special-color toner may preferably be added in an amount, as amount preferable in the present invention, of from 0.15 to 4 parts by weight, more preferably from 0.2 to 2.5 parts by weight, and still more preferably from 0.3 to 1.9 parts by weight, based on 100 parts by weight of the toner particles.

If the external additive of the non-special-color toner is added in an amount of less than 0.15 part by weight, the toner may have a low fluidity to tend to show poor rise of charging or have a low environmental stability of charging.

If on the other hand the external additive of the non-special-color toner is added in an amount of more than 4 parts by weight, some external additive liberated from toner particles tends to accumulate when the toner is used over a long period of time, so that the carrier particle surfaces may be contaminated with the external additive to make it unable to maintain preferable charging performance, tending to cause image defects. Also, the external additive liberated tends to fly on the electrostatic latent image bearing member surface at the time of development, tending to cause melt adhesion of external additive to, or faulty cleaning on, the electrostatic latent image bearing member. Moreover, if the external additive is contained in a large quantity, OHP projected images may come dark, making it unable to obtain sharp color images.

The external additive added externally to the toner particles is described below.

As the external additive used in the present invention, it is preferable to use, as fluidity-providing agents, inorganic fine powders such as silica, alumina and titanium oxide powders, and organic fine powders such as polytetrafluoroethylene, polyvinylidene fluoride, polymethyl methacrylate, polystyrene and silicone powders. The external addition of any of the above fluidity-providing agents to the toner particles is to allow the fine powder to exist between the toner and the carrier or between toner particles. This can provide the special-color toner with preferable fluidity, so that the above requirements (1) and (2) can be satisfied with ease. In addition, this brings about an improvement in charging start performance, environmental stability, transfer performance and so forth of the developer, and also gives rise to an improvement in service life of the developer.

The above fine powder may preferably have a number-average particle diameter of from 3 nm to 100 nm. If it has an average particle diameter of more than 100 nm, it may have less effect of improving the fluidity, resulting in a low image quality because of a poor performance at the time of development and at the time of transfer in some cases. If it has an average particle diameter of less than 3 nm, such a powder makes it difficult to maintain fluidity at the time of running.

Any of these fluidity-providing agents may preferably have a surface area of 30 $m^2/g$ or more, and particularly in the range of from 50 to 400 $m^2/g$, as specific surface area measured by the BET method using nitrogen adsorption.

Any of these fluidity-providing agents may also be added in combination of two or more, which also may be added in the amount defined as above, whereby the toner obtained can be improved in charging performance, environmental stability, fluidity and so forth.

Where the toner is a negatively chargeable toner, it is preferable to use, among the fluidity-providing agents described above, fine silica powder as at least one agent and fine titanium oxide powder as at least one agent and fine titanium oxide powder as at least one agent and fine titanium oxide powder as another agent. That is, the fine silica powder has higher negative chargeability than fluidity-providing agents such as fine alumina powder and fine titanium oxide powder, and hence has so high adherence to toner particles that the liberation of the external additive can be controlled. Hence, the electrostatic latent image bearing member can be kept from filming on its surface, or the charging member from being contaminated. On the other hand, the fine silica powder is liable to lower the environmental stability of toner, tending to cause a decrease in charge quantity of the toner environment of high humidity and an increase in charge quantity of the toner in an environment of low humidity. As for the fine titanium oxide powder, it can make uniform charging rise performance, charge-up proofness, environmental stability and charge distribution. On the other hand, it tends to accumulate in the developer chamber during long-term use to cause a lowering of chargeability of the developer.

Accordingly, at least two agents, the fine silica powder and the fine titanium oxide powder, are used in combination, as being preferred because a cooperative effect can be obtained in which properties of the two have been tempered with each other.

In the present invention, the fine silica powder and the fine titanium oxide powder may preferably be in a proportion of silica:titanium oxide of from 1.0:2.0 to 2.0:1.0, where the cooperative effect can effectively be obtained in which properties of both the fine silica powder and the fine titanium oxide powder have been tempered with each other.

In order to maintain charging performance in an environment of high humidity, the fluidity-providing agent may preferably be subjected to hydrophobic treatment. An example of such hydrophobic treatment is shown below.

A silane coupling agent is available as one of hydrophobic-treatment agents. It may be used in an amount of from 1 to 40 parts by weight, and preferably from 2 to 35 parts by weight, based on 100 parts by weight of the fluidity-providing agent base material. As long as the treating agent is in an amount of from 1 to 40 parts by weight, the toner can be improved in moisture resistance to prevent agglomerates from occurring.

As another hydrophobic-treatment agent, silicone oil is also available.

For the purpose of imparting various toner properties, other external additives may be added. Such external additives may preferably have a particle diameter of not larger than ⅕ of the weight-average diameter of the toner in view of their durability when added to the toner particles. As these additives, for the purpose of providing various properties, an abrasive, a lubricant and charge controlling particles may be used, for example.

As the abrasive, it may include, e.g., metal oxides such as cerium oxide, aluminum oxide, magnesium oxide and chromium oxide; nitrides such as silicon nitride; carbides such as silicon carbide; and metal salts such as strontium titanate, calcium sulfate, barium sulfate and calcium carbonate.

As the lubricant, it may include, e.g., powders of fluorine resins such as vinylidene fluoride and polytetrafluoroethylene, and fatty acid metal salts such as zinc stearate and calcium stearate.

As the charge controlling particles, they may include, e.g., particles of metal oxides such as tin oxide, zinc oxide and aluminum oxide; and carbon black.

To measure the average particle diameter of any of these external additives, the external additive is observed with a transmission electron microscope, and diameters of 100 particles in the visual field are measured to determine the average particle diameter.

The toner (special-color toner or non-special-color toner) according to the present invention may preferably be one comprising toner particles containing at least a binder resin and a colorant, and the external additive added thereto. The toner particles according to the present invention may preferably have a weight-average particle diameter of from 3.0 μm to 10.5 μm, and more preferably from 4.5 μm to 8.5 μm.

If the toner particles have a weight-average particle diameter (D4) of more than 10.5 μm, the toner which develops electrostatic latent images is too large to faithfully develop the electrostatic latent images, tending to scatter when transferred electrostatically. If on the other hand the toner particles have a weight-average particle diameter of less than 3.0 μm, the toner may have poor fluidity, and the replenishing developer tends not to be well sent out of the replenishing developer holding container.

To measure the particle diameter of the toner, a method making use of Coulter Counter is available, for example. Stated specifically, to 100 to 150 ml of an electrolytic solution, 0.1 to 5 ml of a surface active agent (alkylbenzene sulfonate) is added, and 2 to 20 mg of a sample to be measured is added thereto. The electrolytic solution in which the sample has been suspended is subjected to dispersion for about 1 minute to about 3 minutes by means of an ultrasonic dispersion machine. Particle size distribution and so forth of toner particles of 0.3 μm to 40 μm in diameter are measured on the basis of volume, by means of Coulter Counter, using an aperture (e.g., 100 μm) adapted appropriately to toner particle size. The number-average particle diameter and weight-average particle diameter measured under these conditions are determined by computer processing.

The special-color toner may also preferably be more improved in fluidity in order for the carrier to be free from segregation in the special-color color component replenishing developer holding container and to be replenished into the developer chamber of the developing assembly a stable toner concentration.

As the special-color toner, the black toner is commonly frequently used. Accordingly, in order to obtain good color images and, at the same time, to improve the fluidity of the black toner, black toner particles as special-color toner particles may preferably be made to have a weight-average particle diameter which is larger by 0.5 μm to 1.5 μm than the non-special-color color toner particles.

If the former is larger by less than 0.5 μm than the latter, the segregation of the carrier in the black replenishing developer holding container tends to occur because of environmental variations even when the quantity of the external additive is optimized, so that the black replenishing developer may be replenished into the developer chamber in an unstable carrier concentration. If on the other hand the former is larger by more than 1.5 μm than the latter, differences in properties are liable to occur between the black toner and the color toners even when the quantity of the external additive is optimized, tending to cause transfer toner scatter in full-color images and image deterioration such as a lowering of highlight gradation reproducibility.

As the binder resin used in the toner particles, the following binder resin may be used. For example, it may include, e.g., homopolymers of styrene and derivatives thereof, such as polystyrene, poly-p-chlorostyrene and polyvinyl toluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; and polyvinyl chloride, phenol resins, natural-resin modified phenol resins, natural-resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins. As preferred binder resins, they include styrene copolymers and polyester resins.

The styrene polymers or styrene copolymers may be those having been cross-linked, and may further be mixed resins of uncross-linked resins and cross-linked resins.

As a cross-linking agent for the binder resin, a compound having at least two polymerizable double bonds may be used. For example, it may include aromatic divinyl compounds such as divinyl benzene and divinyl naphthalene; carboxylic acid esters having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in the form of a mixture.

The cross-linking agent may preferably be added in an amount of from 0.001 to 10 parts by weight based on 100 parts by weight of the polymerizable monomer used in producing the binder resin.

The toner (special-color toner or non-special-color toner) according to the present invention may contain a charge control agent.

Those capable of controlling toner particles to be negatively chargeable may include the following materials. For example, organic metal complexes or chelate compounds are effective. Also, monoazo metal complexes, acetylacetone metal complexes, and aromatic hydroxycarboxylic acid or aromatic dicarboxylic acid metal compounds may preferably be used. They may further include aromatic hydroxycarboxylic acids, aromatic mono- or polycarboxylic acids, and metal salts of these, anhydrides of these, esters of these, and phenol derivatives of these such as bisphenol derivatives; and urea derivatives, metal-containing salicylic acid compounds, metal-containing naphthoic acid compounds, boron compounds, quaternary ammonium salts, carixarene, silicon compounds, a styrene-acrylic acid copolymer, a styrene-methacrylic acid copolymer, a styrene-acrylic-sulfonic acid copolymer, and non-metal carboxylic acid compounds.

Those capable of controlling toner particles to be positively chargeable may include the following materials. For example, amino compounds, quaternary ammonium salts, and organic dyes, in particular, basic dyes and salts thereof are known, which may include benzyldimethyl-hexadecylammonium chloride, decyl-trimethylammonium chloride, Nigrosine bases, Nigrosine hydrochloride, Safranine Y and Crystal Violet. These dyes may also be used as colorants.

Any of these charge control agents may be used alone or in a combination of two or more types. The charge control agent may be added in an amount of from 0.01 to 20 parts by weight, preferably from 0.1 to 10 parts by weight, and more preferably from 0.2 to 4 parts by weight, based on 100 parts by weight of the binder resin of the toner.

As colorants of the toners used in the present invention, colorants exemplified below may be used.

As yellow colorants, compounds typified by condensation azo compounds, isoindolinone compounds, anthraquinone compounds, azo metal complexes, methine compounds or allylamide compounds may be used. Stated specifically, C.I. Pigment Yellow 12, 13, 14, 15, 17, 62, 74, 83, 93, 94, 95, 97, 109, 110, 111, 128, 129, 147, 168 or 180 may preferably be used. A dye such as C.I. Solvent Yellow 93, 162 or 163 may further be used in combination.

As magenta colorants, condensation azo compounds, diketopyrrolopyrrole compounds, anthraquinone compounds, quinacridone compounds, basic dye lake compounds, naphthol compounds, benzimidazolone compounds, thioindigo compounds or perylene compounds may be used. Stated specifically, C.I. Pigment Red 2, 3, 5, 6, 7, 23, 48:2, 48:3, 48:4, 57:1, 81:1, 144, 146, 166, 169, 177, 184, 185, 202, 206, 220, 221 or 254 may preferably be used.

As cyan colorants, copper phthalocyanine compounds and derivatives thereof, anthraquinone compounds or basic dye lake compounds may be used. Stated specifically, C.I. Pigment Blue 1, 7, 15, 15:1, 15:2, 15:3, 15:4, 60, 62 or 66 may particularly preferably be used.

Carbon black, magnetic materials, and colorants toned into black by the use of the yellow, magenta and cyan colorants shown above may be used as black colorants.

Any of these colorants may be used alone, in the form of a mixture, or in the state of a solid solution. The colorants in the present invention are selected taking account of hue angle, chroma, brightness, weatherability, transparency on OHP films and dispersibility in toner particles. The colorant may preferably be added in an amount of from 1 to 20 parts by weight based on 100 parts by weight of the binder resin.

The toner according to the present invention may contain a wax. This is also a preferred embodiment. The wax may preferably be contained in an amount of from 1 to 20 parts by weight based on 100 parts by weight of the binder resin.

Where the toner is produced by a pulverization process in which a mixture having the binder resin, the colorant and the wax is melt-kneaded, followed by cooling, pulverization and then classification to produce toner particles, the wax may preferably be added in an amount of from 1 to 10 parts by weight, and more preferably from 2 to 7 parts by weight, based on 100 parts by weight of the binder resin.

Where the toner is produced by a polymerization process in which a mixture having a polymerizable monomer, the colorant and the wax is subjected to polymerization to produce toner particles directly, the wax may preferably be added in an amount of from 2 to 20 parts by weight, and more preferably from 5 to 15 parts by weight, based on 100 parts by weight of the polymerizable monomer or the resin synthesized by the polymerization of the polymerizable monomer.

In the present invention, the external additive is used in a larger quantity in the black toner than in the color toners, and the black toner is higher in a coverage of the toner particle surfaces than the color toners. Hence, even in the toner containing the wax, the agglomeration of the toner and carrier in the replenishing developer holding container can be effectively prevented, or the spent toner can be effectively prevented from being incorporated into the carrier.

In addition, the wax usually has a lower polarity than the binder resin. Hence, in a polymerization process in which polymerization is carried out in an aqueous medium, the wax can be used in a larger quantity than in the pulverization process because the wax can be easily incorporated inside toner particles in a large quantity. Hence, a better effect of preventing offset can be obtained when the toner is produced by polymerization.

In addition, any agglomerates of toner particles themselves or of toner particles and carrier particles can not easily form in the container holding the replenishing developer for the auto-refresh developing system and the replenishing developer can well be sent out of the container, and hence a wax-containing toner produced by polymerization is preferred in the present invention.

If the wax is less than the lower limit, the toner tends to have a low anti-offset effect. If on the other hand the wax is more than the upper limit, the toner tends to have a low anti-blocking effect to adversely affect the anti-offset effect, tending to cause drum adhesion or sleeve adhesion, and the toner particles are liable to have a broad particle size distribution especially in the case of the toner produced by polymerization.

The toner used in the present invention may preferably have an average circularity of 0.960 or more, and more preferably 0.970 or more. Such a toner having an average circularity of 0.960 or more is preferable because the replenishing developer can much better be sent out of the container.

In order to obtain the toner having the above average circularity, it is preferable to produce the toner by polymerization. A replenishing developer making use of the toner produced by pulverization has a large void volume relative to the toner particle shape and particle size distribution. Hence, it tends to have poor fluidity to cause the segregation of the carrier, and besides, it is necessary to enlarge the volume of the replenishing developer holding container, making it difficult to make the image forming apparatus compact.

Methods for producing the toner particles used in the present invention are described below. The toner particles used in the present invention may be produced by known pulverization and polymerization processes.

In the process for producing pulverization toner particles, the binder resin, the wax, the pigment, dye or magnetic material as the colorant, and optionally the charge control agent and other additives are thoroughly mixed by means of a mixing machine such as a Henschel mixer or a ball mill, and then the mixture obtained is melt-kneaded using a heat kneading machine such as a heating roll, a kneader or an extruder to melt the resin components, in which the metallic compound and the pigment, dye or magnetic material are dispersed or dissolved, and the kneaded product obtained is cooled to solidify, followed by pulverization and classification to produce the toner particles.

The toner particles and any desired external additive may further optionally thoroughly be mixed by means of a mixing machine such as a Henschel mixer to produce the toner used in the present invention.

In the process for producing polymerization toner particles, the toner particles may be produced by the method disclosed in Japanese Patent Publication No. S56-13945, in which a molten mixture is atomized in the air by means of a disk or multiple fluid nozzles to produce spherical toner particles; the method disclosed in Japanese Patent Publication No. S36-10231 and Japanese Patent Applications Laid-open No. S59-53856 and No. S59-61842, in which toner particles are directly produced by suspension polymerization; a dispersion polymerization process in which toner particles are directly produced using an aqueous organic solvent in which monomers are soluble and polymers obtained are insoluble; an emulsion polymerization process as typified by soap-free polymerization in which toner particles are produced by direct polymerization in the presence of a water-soluble polar polymerization initiator; or a hetero-agglomeration process in which emulsion polymerization particles are previously made and thereafter polar particles having a polarity reverse to the polarity of the polymerization particles are added to effect association.

In particular, the suspension polymerization is preferred in which a monomer composition containing at least the polymerizable monomer, the colorant and the wax is subjected to polymerization to produce toner particles directly.

What is called seed polymerization may also preferably be used in the present invention, which is a process in which a monomer is further adsorbed on polymerization particles obtained first and thereafter a polymerization initiator is used to effect polymerization.

EXAMPLES

The present invention is described below by giving Examples to which the present invention is by no means limited.

Production of Carriers:

Production of Carrier 1

| | (by weight) |
|---|---|
| Phenol (hydroxybenzene) | 50 parts |
| Aqueous 37% by weight formalin solution | 80 parts |
| Water | 50 parts |
| Fine magnetite particles surface-treated with silane type coupling agent (KBM403, available from Shin-Etsu Chemical Co., Ltd.) | 320 parts |
| Fine $\alpha$-$Fe_2O_3$ particles surface-treated with silane type coupling agent (KBM403, available from Shin-Etsu Chemical Co., Ltd.) | 80 parts |
| Aqueous 25% by weight ammonia | 15 parts |

The above materials were put into a four-necked flask. Temperature was raised to 85° C. over a period of 50 minutes with stirring and mixing, and kept at that temperature, where the reaction was carried out for 120 minutes to effect curing. Thereafter, the reaction mixture was cooled to 30° C., and 500 parts by weight of water was added thereto. Then, the supernatant formed was removed, and the precipitate was washed with water, followed by air drying. Subsequently, the air-dried product was further dried at 160° C. for 24 hours under reduced pressure (665 Pa=5 mmHg) to produce magnetic carrier cores (A) having phenolic resin as a binder resin.

In a treating machine, the surfaces of the magnetic carrier cores (A) thus obtained were coated with a methanol solution of 3% by weight of a silane coupling agent $\gamma$-aminopropyltrimethoxysilane. During the coating, methanol was evaporated while applying a shear stress continuously to the magnetic carrier cores (A).

While stirring at 50° C. the magnetic carrier cores (A) treated with the silane coupling agent in the treating machine, a silicone resin SR2410 (available from Dow Corning Toray Co., Ltd.) was added under reduced pressure after it was so diluted with toluene as to be 20% in a silicone resin solid content, and the carrier cores were coated with 0.5% by weight of resin.

Subsequently, after toluene was evaporated with stirring for 2 hours in an atmosphere of nitrogen gas, heat treatment was carried out at 140° C. for 2 hours in an atmosphere of nitrogen gas. After agglomerates were broken up, coarse particles of 200 meshes (54 μm sieve opening) or more were removed to obtain Carrier 1.

Carrier 1 thus obtained had a volume-average particle diameter of 35 μm and a true specific gravity of 3.7 g/cm$^3$.

Production of Carrier 2

| | (by weight) |
|---|---|
| Polyester resin composed of terephthalic acid trimellitic anhydride/propylene oxide addition bisphenol-A derivative | 150 parts |
| Fine magnetite particles used in Production Example 1 (Production of Carrier 1) | 500 parts |
| Quaternary ammonium salt compound (P-51, available from Orient Chemical Industries, Ltd.) | 5 parts |

The above materials were thoroughly premixed by means of a Henschel mixer, and the mixture formed was melt-kneaded using a twin-extrusion kneader. The kneaded product obtained was, after cooled, crushed by means of a hammer mill to particles of about 1 to 2 mm in diameter, which were then finely pulverized using a fine-grinding mill of an air-jet system. The finely pulverized product thus obtained was further classified, followed by dry-process coating with 0.02 μm styrene/methyl methacrylate copolymer resin particles by means of Hybridizer (manufactured by Nara Kikai K.K.) to obtain Carrier 2. Physical properties of Carrier 2 are shown in Table 1.

Production of Carriers 3 to 6

Carriers 3 to 6 were obtained in the same manner as in Example 1 except that the proportion of the resin to the magnetite was controlled for the purpose of controlling the true specific gravity. Physical properties of Carriers 3 to 6 are shown in Table 1.

TABLE 1

| | True specific gravity ($g/cm^3$) | Volume-average particle diameter (μm) |
|---|---|---|
| Carrier 1 | 3.70 | 35 |
| Carrier 2 | 3.70 | 35 |
| Carrier 3 | 2.50 | 35 |
| Carrier 4 | 2.32 | 35 |
| Carrier 5 | 4.50 | 35 |
| Carrier 6 | 4.72 | 35 |

Production of Toners

Toner Production Example 1

(Polymerization Black Toner)

First, a polymerization toner was produced by the following procedure. To 900 parts of ion-exchanged water, 3 parts of tricalcium phosphate was added, followed by stirring at 10,000 rpm by means of a TK-type homomixer (manufactured by Tokushu Kika Kogyo Co., Ltd.) to prepare an aqueous medium.

Materials formulated as shown below were also heated to 60° C., followed by stirring at 9,000 rpm to effect uniform dispersion and dissolution.

| | (by weight) |
|---|---|
| Styrene | 160 parts |
| n-Butyl acrylate | 40 parts |
| Carbon black (PRINTEX, available from Degussa Corp.) | 10 parts |
| Aluminum compound of di-t-butylsalicylic acid | 4 parts |
| Saturated polyester resin (a polycondensation product of bisphenol A propylene oxide and isophthalic acid; Tg: 65° C.; Mw: 10,000; Acid Value: 7 mg · KOH/g) | 20 parts |
| Stearyl stearate wax (DSC peak: 60° C.) | 30 parts |
| Divinylbenzene | 0.6 part |

In the mixture formed, 5 parts of a polymerization initiator 2,2'-azobis(2,4-dimethylvaleronitrile) was dissolved to prepare a polymerizable monomer composition.

The polymerizable monomer composition was introduced into the above aqueous medium, followed by stirring at 60° C. in an atmosphere of nitrogen at 6,000 rpm using the TK-type homomixer to granulate the polymerizable monomer composition.

Thereafter, the granulated product obtained was moved to a propeller stirrer, and with stirring, the temperature was raised to 70° C. over 2 hours. Four hours after, the temperature was raised to 80° C. at a heating rate of 40° C./hr, where the reaction was carried out for 5 hours to produce polymer particles. After the polymerization was completed, a slurry containing the polymer particles was cooled, which was then washed with water 10 times the amount of the slurry, followed by filtration, drying, and thereafter classification to control the particle diameter, obtaining Black Toner Particles 1 (base particles).

In 100 parts by weight of the above Black Toner Particles 1, 0.70 parts by weight of hydrophobic fine silica powder (average primary particle diameter: 30 nm) treated with hexamethyldisilazane and 0.70 part by weight of hydrophobic fine titanium oxide powder (average primary particle diameter: 50 nm) treated with n-butyltrimethoxysilane were mixed by means of a Henschel mixer (manufactured by Mitsui Miike Engineering Corporation) to produce Polymerization Black Toner 1 used in the present invention, having a weight-average particle diameter of 6.9 μm.

Toner Production Example 2

(Polymerization Magenta Toner 1)

Polymerization Magenta Toner 1 with a weight-average particle diameter of 6.8 μm was produced in the same manner as in Toner Production Example 1 except that, in place of the carbon black used therein, Quinacridone Red was used in an amount of 8 parts by weight.

Toner Production Example 3

(Polymerization Yellow Toner 1)

Polymerization Yellow Toner 1 with a weight-average particle diameter of 6.8 μm was produced in the same manner as in Toner Production Example 1 except that, in place of the carbon black used therein, C.I. Pigment Yellow 93 was used in an amount of 6.5 parts by weight.

Toner Production Example 4

(Polymerization Cyan Toner 1)

Polymerization Cyan Toner 1 with a weight-average particle diameter of 6.9 μm was obtained in the same manner as in Toner Production Example 1 except that, in place of the carbon black used therein, C.I. Pigment Blue 15:3 was used in an amount of 15 parts by weight.

Toner Production Example 5

(Pulverization Black Toner)

| | (by weight) |
|---|---|
| Polyester resin (a condensation polymer of propoxylated bisphenol A with fumaric acid; Tg: 65° C.; Mw: 7,000; acid value: 10.8 mg · KOH/g) | 100 parts |
| Carbon black (the same as in Toner Production Example 1) | 3.5 parts |
| Aluminum compound of dialkylsalicylic acid | 5 parts |
| Low-molecular-weight polypropylene (DSC peak: 60° C.) | 5 parts |

The above materials were mixed by means of a Henschel mixer, and while suction was carried out from the vent port connected to a suction pump, the mixture formed was melt-kneaded using a twin-extruder. The melt-kneaded product thus obtained was cooled and then crushed by means of a hammer mill to produce a 1 mm mesh-pass crushed product. The crushed product was further pulverized by means of a jet mill, followed by classification using a multi-division classifier (Elbow Jet) to produce black toner particles.

In 100 parts by weight of the black toner particles thus obtained, 0.80 part by weight of hydrophobic fine silica powder (average primary particle diameter: 30 nm) treated with hexamethyldisilazane and 0.80 part by weight of hydrophobic fine titanium oxide powder (average primary particle diameter: 50 nm) treated with n-butyltrimethoxysilane were mixed by means of a Henschel mixer (manufactured by Mitsui Miike Engineering Corporation) to produce a pulverization black toner used in the present invention, having a weight-average particle diameter of 6.5 μm.

Toner Production Example 6

(Pulverization Magenta Toner)

A pulverization magenta toner with a weight-average particle diameter of 6.8 μm was produced in the same manner as in Toner Production Example 5 except that, in place of the carbon black used therein, Quinacridone Red was used in an amount of 2.8 parts by weight.

Toner Production Example 7

(Pulverization Yellow Toner)

A pulverization yellow toner with a weight-average particle diameter of 6.8 μm was produced in the same manner as in Toner Production Example 5 except that, in place of the carbon black used therein, C.I. Pigment Yellow 93 was used in an amount of 2.3 parts by weight.

Toner Production Example 8

(Pulverization Cyan Toner)

A pulverization cyan toner with a weight-average particle diameter of 6.9 μm was produced in the same manner as in Toner Production Example 5 except that, in place of the carbon black used therein, C.I. Pigment Blue 15:3 was used in an amount of 5.3 parts by weight.

Example 1

Using Carrier 1 and Polymerization Black Toner 1, these were uniformly so blended by means of a V-type mixer that the toner was in a proportion of 85% by weight based on the total weight, preparing a replenishing developer for black (special color). As replenishing developers for non-special colors (yellow, magenta and cyan), Polymerization Yellow Toner 1, Polymerization Magenta Toner 1 and Polymerization Cyan Toner 1 were used as they were. The replenishing developer for black and the replenishing developers for non-special colors were put into their corresponding replenishing developer cartridges (the volume of the black replenishing developer cartridge was 3.2 times the volume of each of the non-special-color replenishing developer cartridges; the non-special-color replenishing developer cartridges had a common volume) in amounts of 650 g and 180 g, respectively. The combination of the above special-color replenishing developer cartridge and non-special-color replenishing developer cartridges is designated as Replenishing Developer Kit 1.

In addition, using Carrier 1 in combination with Polymerization Black Toner 1, Polymerization Yellow Toner 1, Polymerization Magenta Toner 1 and Polymerization Cyan Toner 1, each carrier and toner were so blended that the toner was in a proportion of 8% by weight based on the total weight, preparing four-color two-component developers to be put into the developer chambers of the developing assemblies.

Using Replenishing Developer Kit 1 and the four-color two-component developers and using an image forming apparatus having an intermediate transfer member, constructed as shown in FIGS. 1, 2 and 3, a monochromatic original image having an image duty (image area percentage) of 5% was copied using the black toner on 9 sheets of A4-size transfer sheets, and thereafter a full-color original image having an image duty of 5% for each color was copied on 1 sheet of A4-size transfer sheets. This operation was repeated to reproduce images on 70,000 sheets in total. Then, in respect of the special-color black, evaluation was made on changes in image density, image uniformity/image quality, toner scatter, and toner contamination incidental to detachment/attachment of the replenishing developer cartridge. Results obtained are shown in Table 2. Measurement conditions and evaluation criteria for the respective items are shown below.

The evaluation test was made in an environment of high temperature and high humidity (H/H: 32.5° C./90% RH). As transfer sheets, Color Laser Copyer SK Paper (available from CANON INC.) having been moisture-conditioned for 24 hours in an environment of high temperature and high humidity (H/H: 32.5° C./90% RH) was used.

Changes in Image Density:

(Image Density Stability)

Image density was measured with a color reflection densitometer (e.g.,. X-RITE 404A, manufactured by X-RITE Co.). Evaluated by the difference between the initial density and the density after 70,000-sheet extensive operation (running).

A: 0.1% or less.

B: More than 0.1% to 0.2% or less.

C: More than 0.2% to 0.3% or less.

D: More than 0.3%.

Image Uniformity/Image Quality:

Monochromatic solid images and halftone images were printed after the 70,000-sheet running, and their image uniformity was visually detected.

A: Uniform images are formed and no image non-uniformity is seen.

B: Image non-uniformity is somewhat seen.

C: Image non-uniformity is clearly seen.

D: Image non-uniformity seriously appears.

Toner Scatter:

Evaluation on toner scatter was made by observing, after the 70,000-sheet running, contamination due to toner on the outer surfaces of surroundings of the developing sleeve of each developing assembly and contamination due to toner on portions other than the developing assembly, according to the following evaluation criteria.

A: Hardly seen.

B: Contamination is somewhat seen on the outer surface of the upstream-side toner scatter preventive part of the developing assembly, but not seen on the outer surface of the downstream-side toner scatter preventive part.

C: Contamination is seen on the outer surface of the upstream-side toner scatter preventive part and the outer surface of the downstream-side toner scatter preventive part of the developing assembly, but no contamination is seen on portions other than the developing assembly.

D: Contamination is seen also on portions other than the developing assembly.

Toner contamination incidental to detachment/attachment of replenishing developer cartridge:

After the 70,000-sheet running, contamination around the part where the replenishing developer cartridge was set in was observed which was due to the toner fly-up caused when the black replenishing developer cartridge was detached and attached. The contamination became greater in proportion to the number of times for changing the replenishing developer cartridge was replaced. Accordingly, shown in Table 2 is the number of times the replenishing developer cartridge was replaced. In addition, the larger the number of times the replenishing developer cartridge is replaced is, the heavier the load applied to users is, and as a result, this is reflected on the running cost.

Comparative Example 1

Evaluation was made in the same manner as in Example 1 except that the carrier was not contained in the black replenishing developer (only the toner was put into the replenishing developer cartridge in an amount of 553 g) and a developing assembly having no mechanism with which the deteriorated developer (carrier) was collected was used as the black developing assembly. The evaluation results are shown in Table 2. In addition, in Example 1, it was necessary to carry out the running on 600,000 sheets until the results of evaluation reached the same level as those in Comparative Example 1 (excluding the evaluation on the "toner contamination incidental to detachment/attachment of replenishing developer cartridge").

Comparative Example 2

Evaluation was made in the same manner as in Example 1 except that the volume of the black replenishing developer cartridge was equal to that of other-color replenishing developer cartridges and also the quantity of the black replenishing developer (containing the carrier) put into it was changed to 212 g. The evaluation results are shown in Table 2. Good results were obtained on image density stability and so forth, but image quality became seriously poor. The reason is presumed to be that the number of times the replenishing developer cartridge was replaced was large, and the toner contamination incidental to detachment/attachment of the replenishing developer cartridge was so serious that the image quality was remarkably lowered.

Example 2

Evaluation was made in the same manner as in Example 1 except that, in place of Carrier 1, Carrier 2 was used. The evaluation results were good as shown in Table 2.

Example 3

Evaluation was made in the same manner as in Example 1 except that, in place of Carrier 1, Carrier 3 was used. The evaluation results were good as shown in Table 2.

Example 4

Evaluation was made in the same manner as in Example 1 except that, in place of Carrier 1, Carrier 4 was used. The evaluation results show, as shown in Table 2, that the image quality became somewhat low. This is presumed to be due to the fact that the content of the magnetic material in the carrier was reduced so that the carrier has a small true specific gravity, and the carrier somewhat adhere to the electrostatic latent image bearing member.

Example 5

Evaluation was made in the same manner as in Example 1 except that, in place of Carrier 1, Carrier 5 was used. The evaluation results were good as shown in Table 2.

Example 6

Evaluation was made in the same manner as in Example 1 except that, in place of Carrier 1, Carrier 6 was used. The evaluation results show, as shown in Table 2, that the image density stability became somewhat low. This is presumed to be due to the fact that, because of a large true specific gravity of the carrier, the driving means operated in rotary motion segregates the carrier in the cartridge to somewhat lower the charging performance of the developer in the developer chamber.

Example 7

Evaluation was made in the same manner as in Example 1 except that, in place of Polymerization Black, Yellow, Magenta and Cyan Toners 1, the pulverization black, yellow, magenta and cyan toners were used. The evaluation results are shown in Table 2. As shown in Table 2, good results were obtained.

Example 8

Evaluation was made in the same manner as in Example 1 except that, using Carrier 1 and Polymerization Black Toner 1, these were uniformly so blended by means of a V-type mixer that the toner was in a proportion of 99% by weight based on the total weight, preparing a replenishing developer for black (special color). The evaluation results were somewhat poor in all items, as shown in Table 2. The reason is presumed to be that, due to a little small content of the carrier in the replenishing developer, it was difficult to make the chargeability of the carrier in the developer chamber stable in good efficiency.

Examples 9 and 10

Evaluation was made in the same manner as in Example 1 except that Carrier 1 and Polymerization Black Toner 1 were uniformly so blended by means of a V-type mixer that the toner was in a proportion of 70% by weight and 65% by weight based on the total weight, preparing replenishing developers for black (special color). The evaluation results were somewhat poor in all items, as shown in Table 2. The reason is presumed to be that, due to a little large content of the carrier in the replenishing developer, the carrier in the developer chamber was not smoothly replaced with fresh one, so that the chargeability became somewhat unstable.

TABLE 2

| | Changes in image density | Image uniformity/ image quality | Toner scater | Number of times of black cartridge replacement |
|---|---|---|---|---|
| Example: | | | | |
| 1 | A | A | A | 3 |
| Comparative Example: | | | | |
| 1 | D | D | D | 3 |
| 2 | A | C | A | 11 |

TABLE 2-continued

| | Changes in image density | Image uniformity/ image quality | Toner scater | Number of times of black cartridge replacement |
|---|---|---|---|---|
| Example: | | | | |
| 2 | B | B | B | 3 |
| 3 | B | B | B | 3 |
| 4 | C | C | C | 3 |
| 5 | B | B | B | 3 |
| 6 | C | C | C | 3 |
| 7 | B | B | B | 3 |
| 8 | C | C | B | 3 |
| 9 | B | C | B | 4 |
| 10 | C | C | C | 4 |

Toner Production Example 1

(Polymerization Cyan Toner)

In 710 parts by weight of ion-exchanged water, 450 parts by weight of an aqueous 0.1M $Na_3PO_4$ solution was introduced, followed by heating to 60° C. and then stirring at 12,000 rpm using a TK-type homomixer (manufactured by Tokushu Kika Kogyo Co., Ltd.). To the resultant mixture, 68 parts by weight of an aqueous 1.0M $CaCl_2$ solution was added little by little to produce an aqueous medium containing $Ca_3(PO_4)_2$.

| | (by weight) |
|---|---|
| Styrene | 165 parts |
| n-Butyl acrylate | 35 parts |
| Carbon black (colorant) (average primary particle diameter: 30 nm; specific surface area: 150 $m^2/g$; DBP oil absorption: 48 mg/100 g) | 10 parts |
| Di-t-butylsalicylic acid aluminum compound (charge control agent) | 5 parts |
| Saturated polyester (a condensation product of bisphenol A propylene oxide with isophthalic acid; Tg: 65° C.; Mw: 10,000; acid value: 7 mg · KOH/g) | 10 parts |
| Ester wax (behenyl behenate; DSC peak: 70° C.) | 50 parts |

The above materials were heated to 60° C. and uniformly dissolved or dispersed by means of a TK-type homomixer (manufactured by Tokushu Kika Kogyo Co., Ltd.) at 11,000 rpm. To the mixture obtained, 10 parts by weight of a polymerization initiator 2,2'-azobis(2,4-dimethylvaleronitrile) was dissolved to prepare a polymerizable monomer composition.

The polymerizable monomer composition was introduced in the above aqueous medium, followed by stirring for 10 minutes at 60° C. in an atmosphere of nitrogen, using the TK-type homomixer at 11,000 rpm to granulate the polymerizable monomer composition. Thereafter, the granulated product obtained was stirred with a paddle stirring blade during which the temperature was raised to 80° C., where the reaction was carried out for 10 hours. After the polymerization reaction was completed, residual monomers were evaporated off under reduced pressure, the reaction system was cooled, and thereafter hydrochloric acid was added to dissolve the calcium phosphate, followed by filtration, washing and then drying to produce black toner particles with a weight-average particle diameter of 7.8 μm.

To 100 parts by weight of the above black toner particles, 0.70 part by weight of hydrophobic fine silica powder (average primary particle diameter: 30 nm) treated with hexamethyldisilazane and 0.70 part by weight of hydrophobic fine titanium oxide powder (average primary particle diameter: 50 nm) having been treated with n-butyltrimethoxysilane were externally added to obtain Polymerization Black Toner 2 as shown in Table 3.

Toner Production Examples 10 to 14

(Polymerization Black Toners 3 to 7)

Polymerization Black Toners 3 to 7 as shown in Table 3 were obtained in the same manner as in Toner Production Example 9 except that in Toner Production Example 9 the hydrophobic fine silica powder and hydrophobic fine titanium oxide powder were added in the amounts changed as shown in Table 3.

Toner Production Examples 15 to 19

(Polymerization Black Toners 8 to 12)

Polymerization Black Toners 8 to 12 as shown in Table 3 were obtained in the same manner as in Toner Production Example 9 except that in Toner Production Example 9 the amount of the aqueous calcium phosphate medium added was controlled to change the particle diameters of the toners, and the hydrophobic fine silica powder and hydrophobic fine titanium oxide powder were added in the amounts changed as shown in Table 3.

Toner Production Example 20

(Polymerization Cyan Toner 2)

Polymerization Cyan Toner 2 as shown in Table 3 was obtained in the same manner as in Toner Production Example 9 except that, in place of the carbon black used in Toner Production Example 9, C.I. Pigment Blue was used in an amount of 15 parts by weight, the amount of the aqueous calcium phosphate medium added was controlled to change the particle diameter of the toner, and the hydrophobic fine silica powder and hydrophobic fine titanium oxide powder were added in the amounts changed as shown in Table 3.

Toner Production Examples 21 to 23

(Polymerization Cyan Toners 3 to 5)

Polymerization Cyan Toners 3 to 5 as shown in Table 3 were obtained in the same manner as in Toner Production Example 20 except that in Toner Production Example 20 the amount of the aqueous calcium phosphate medium added therein was controlled to change the particle diameters of the toners and the hydrophobic fine silica powder and hydrophobic fine titanium oxide powder were added in the amounts changed as shown in Table 3.

Toner Production Example 24

(Polymerization Magenta Toner 2)

Polymerization Magenta Toner 2 as shown in Table 3 was obtained in the same manner as in Toner Production Example 20 except that, in place of C.I. Pigment Blue used in Toner Production Example 20, Quinacridone Red was used in an amount of 8 parts by weight.

Toner Production Example 25

(Polymerization Yellow Toner 2)

Polymerization Yellow Toner 2 as shown in Table 3 was obtained in the same manner as in Toner Production Example 20 except that, in place of C.I. Pigment Blue used in Toner Production Example 20, C.I. Pigment Yellow was used in an amount of 6.5 parts by weight.

TABLE 3

| | Toner | | External additives | | | |
|---|---|---|---|---|---|---|
| | av. particle diam. (μm) | True specific gravity (g/cm$^3$) | Hydrophobic silica (pbw) | Hydrophobic titanium oxide (pbw) | Surface coverage | Average circularity |
| Black toner: | | | | | | |
| 2 | 7.8 | 1.10 | 0.63 | 0.64 | 1.82 | 0.975 |
| 3 | 7.8 | 1.10 | 0.47 | 0.48 | 1.35 | 0.975 |
| 4 | 7.8 | 1.10 | 0.45 | 0.46 | 1.30 | 0.976 |
| 5 | 7.8 | 1.10 | 0.45 | 0.45 | 1.29 | 0.973 |
| 6 | 7.8 | 1.10 | 0.96 | 0.97 | 2.76 | 0.974 |
| 7 | 7.8 | 1.10 | 1.13 | 1.14 | 3.25 | 0.975 |
| 8 | 7.0 | 1.10 | 0.73 | 0.73 | 1.87 | 0.974 |
| 9 | 7.4 | 1.10 | 0.47 | 0.47 | 1.28 | 0.976 |
| 10 | 8.5 | 1.10 | 0.41 | 0.41 | 1.28 | 0.975 |
| 11 | 8.7 | 1.10 | 0.40 | 0.40 | 1.28 | 0.973 |
| 12 | 10.7 | 1.10 | 0.32 | 0.33 | 1.28 | 0.974 |
| Cyan toner: | | | | | | |
| 2 | 6.8 | 1.11 | 0.49 | 0.50 | 1.25 | 0.975 |
| 3 | 6.3 | 1.11 | 0.53 | 0.54 | 1.25 | 0.974 |
| 4 | 4.5 | 1.11 | 0.75 | 0.75 | 1.25 | 0.976 |
| 5 | 3.0 | 1.11 | 1.13 | 1.13 | 1.25 | 0.972 |
| Magenta toner: | | | | | | |
| 2 | 6.8 | 1.11 | 0.50 | 0.50 | 1.25 | 0.972 |
| Yellow toner: | | | | | | |
| 2 | 6.9 | 1.11 | 0.50 | 0.50 | 1.27 | 0.975 |

Example 11

Using Carrier 1 in combination with Polymerization Black Toner 2, Polymerization Cyan Toner 2, Polymerization Magenta Toner 2 and Polymerization Yellow Toner 2, the carrier and each of the toners were so blended that the toner was in a proportion of 8% by weight based on the total weight, to prepare respective four-color two-component developers. Also, using Carrier 1 and Polymerization Black Toner 2, these were uniformly so blended that the toner was in a proportion of 85% by weight based on the total weight, to prepare a black replenishing developer (special-color color component replenishing developer).

As replenishing developers for non-special colors (yellow, magenta and cyan), Polymerization Yellow Toner 2, Polymerization Magenta Toner 2 and Polymerization Cyan Toner 2 were used as they were. The replenishing developer for black and the replenishing developers for non-special colors were put into their corresponding replenishing developer cartridges (the volume of the black replenishing developer cartridge was 3.2 times the volume of each of the non-special-color replenishing developer cartridges; the non-special-color replenishing developer cartridges had common volume.) in amounts of 650 g and 180 g, respectively. The combination of the above special-color replenishing developer cartridge and non-special-color replenishing developer cartridges is designated as Replenishing Developer Kit 2.

Using Replenishing Developer Kit 2 and the four-color two-component developers, images were formed in the same manner as in Example 1 except that the number of sheets in the running test was changed to 150,000 sheets, and the environment for evaluation was changed to 25.0° C./60% RH. Evaluation was made on the following items. The results are shown in Tables 4 and 5. In addition, in all Examples and Comparative Examples shown below, the black replenishing developer cartridge was replaced 7 times.

Measurement conditions and evaluation criteria for the respective items are shown below.

Charge Stability:

As to the charge stability, 0.3 g of each of the two-component developers on the developing sleeves in the respective-color developer chambers was collected every 5,000 sheets in image reproduction in respect of the color developers, and every 20,000 sheets in image reproduction in respect of the black developer. Triboelectric charge quantity of each of them was measured, and the charge stability was evaluated by changes in triboelectric charge quantity. For evaluation, the change width between charge quantity at the time of start and charge quantity at the time of collection was expressed in "%". Evaluation was made according to the following criteria.

(Evaluation Criteria)

A: The maximum change width of charge quantity is 0% to less than 5%.

B: The maximum change width of charge quantity is 5% to less than 10%.

C: The maximum change width of charge quantity is 10% to less than 15% or more.

D: The maximum change width is 15% or more.

The triboelectric charge quantity was measured in the following way.

0.3 g of each two-component developer is put into a container made of a metal at the bottom of which a conductive screen of 625 meshes is provided, and is sucked by means of a suction device, and the triboelectric charge quantity is determined from the differences in weight between before and after the suction and from the potential accumulated in a capacitor connected to the container. Here, suction pressure is set at 250 mmHg. According to this method, the triboelectric charge quantity (Q) is calculated using the following expression.

$$Q(\text{mC/kg})=\{C/(W1\times W2)\}\times 100$$

wherein W1 is the weight of the two-component developer before the suction, W2 is the toner concentration (%) of the two-component developer, and C is the potential accumulated in the capacitor.

The toner concentration of the two-component developer is measured by a known method after the two-component developer collected has been washed with ion-exchanged water containing 1% of CONTAMINON N (a surface-active agent available from Wako Pure Chemical Industries, Ltd.) to separate the toner and the carrier, followed by drying and moisture conditioning (25.0° C./60% RH).

Toner Scatter:

Evaluation on toner scatter was made by examining, after the 150,000-sheet running, contamination due to toner on the outer surfaces of surroundings of the developing sleeve of each developing assembly and any contamination due to toner on portions other than the developing assembly, according to the following evaluation criteria.

A: Hardly seen at all.

B: Contamination is somewhat seen on the outer surface of the upstream-side or downstream-side toner scatter preventive part of the developing assembly.

C: Contamination is seen on the outer surface of the upstream-side and downstream-side toner scatter preventive part.

D: Contamination is seen also on portions other than the developing assembly.

Fog:

With regard to the fog, after the 150,000-sheet running, the reflection density of white paper and the reflection density of non-image areas of paper on which images were reproduced using the copying machine were measured with a reflection densitometer (DENSITOMETER TC6MC, manufactured by Tokyo Denshoku Technical Center). The difference in reflection density between the two was examined on the basis of the reflection density of white paper, and what showed the worst fog among the four colors was expressed according to the following evaluation criteria.

(Evaluation Criteria)

A: Less than 0.5%.

B: 0.5% to less than 1.0%.

C: 1.0% to less than 2.0%.

D: 2.0% or more.

Image Uniformity/Image Quality:

After the 150,000-sheet running, solid monochromatic images and four-color halftone image superimposed images were printed, and their image uniformity was visually evaluated according to the following evaluation criteria. In addition, in Examples and Comparative Examples shown below, in cases where the magenta and yellow developers were not used, the image uniformity/image quality was evaluated on black and cyan solid monochromatic images and two-color halftone image superimposed images printed, and their image uniformity was visually evaluated.

A: Images are uniform, and any non-uniform image does not appear.

B: Non-uniform images are somewhat seen.

C: Non-uniform images are seen.

D: Non-uniform images have appeared greatly.

Black Fine-Line Reproducibility:

Fine-line reproducibility was measured in the following way: An image formed by copying under proper copying conditions an original image with fine lines of accurately 100 μm in width is used as a sample for measurement. Using a LUZEX 450 particle analyzer as a measuring instrument and from an enlarged monitor image, the line width is measured with an indicator. Here, as the measurement position of the line width, fine-line images have unevenness in their width directions and hence an average line width of lines with such unevenness is measured at measurement points. Thus, the value (%) of fine-line reproducibility is calculated according to the following expression:

$$\text{Fine-line reproducibility (\%)} = ((\text{line width of copied image, determined by measurement})/(\text{line width of original image}))\times 100.$$

Examples 12 to 14

Evaluation was made in the same manner as in Example 11 except that Polymerization Black Toner 2 was changed for Polymerization Black Toners 3 to 5, and Polymerization Magenta Toner 2 and Polymerization Yellow Toner 2 were not used. As shown in Tables 4 and 5, results were obtained which were somewhat inferior to those in Example 11. The reason is presumed to be that the difference in external additive surface coverage came to be small between the black toner and the color toner.

Examples 15 & 16

Evaluation was made in the same manner as in Example 11 except that Polymerization Black Toner 2 was changed for Polymerization Black Toners 6 and 7, and Polymerization Magenta Toner 2 and Polymerization Yellow Toner 2 were not used. As shown in Tables 4 and 5, results were obtained which were somewhat inferior to those in Example 11 in regard to the image uniformity/image quality and the fine-line reproducibility. The reason is presumed to be that a difference in transfer performance occurred between the black toner and the color toners as the difference in external additive surface coverage became larger between the black toner and the color toner.

Example 17

Evaluation was made in the same manner as in Example 11 except that Polymerization Black Toner 2 was changed for Polymerization Black Toner 8, and Polymerization Magenta Toner 2 and Polymerization Yellow Toner 2 were not used. As shown in Tables 4 and 5, results were obtained which were somewhat inferior to those in Example 11. The reason is presumed to be that there was no difference in particle diameter between the black toner and the color toners, and hence the black toner had somewhat low fluidity and the replenishing developer was slightly poorly sent out of the replenishing developer holding container.

Examples 18 to 21

Evaluation was made in the same manner as in Example 11 except that Polymerization Black Toner 2 was changed for Polymerization Black Toners 9 to 12, and Polymerization Magenta Toner 2 and Polymerization Yellow Toner 2 were not used. As shown in Tables 4 and 5, results were obtained which were somewhat inferior to those in Example 11 in regard to the image uniformity/image quality and the fine-line reproducibility. The reason is presumed to be that a difference in properties occurred between the black toner and the color toners as the difference in particle diameter became larger between the black toner and the color toners, causing image defects such as transfer scatter around line images of full-color images and a lowering in highlight gradation reproducibility.

Examples 22 to 24

Evaluation was made in the same manner as in Example 11 except that Polymerization Cyan Toner 2 was changed for Polymerization Cyan Toners 3 to 5, and Polymerization Magenta Toner 2 and Polymerization Yellow Toner 2 were not used. As shown in Tables 4 and 5, results were obtained which were somewhat inferior in the charge stability, fog and so forth as the cyan toners had smaller particle diameters. This is presumably because the cyan developers had lower fluidity as the cyan toners had smaller particle diameters, resulting in somewhat low charge rise performance of toners.

Example 25

A commercially available copying machine CP2120 (manufactured by CANON INC.) was remodeled into the FIG. 5 image forming apparatus making use of the auto-refresh developing system for only black, and images were reproduced on 150,000 sheets by using the same two-component developers and replenishing developers as in Example 11. Images thus formed were evaluated in the same manner as in Example 11. The results are shown in Tables 4 and 5.

TABLE 4

| Example: | Black toner | Cyan toner | Magenta toner | Yellow toner | Difference in surface coverage |
|---|---|---|---|---|---|
| 11 | PBT 2 | PCT 2 | PMT 2 | PYT 2 | 0.55 to 0.57 |
| 12 | PBT 3 | PCT 2 | — | — | 0.10 |
| 13 | PBT 4 | PCT 2 | — | — | 0.05 |
| 14 | PBT 5 | PCT 2 | — | — | 0.04 |
| 15 | PBT 6 | PCT 2 | — | — | 1.50 |
| 16 | PBT 7 | PCT 2 | — | — | 2.00 |
| 17 | PBT 8 | PCT 2 | — | — | 0.57 |
| 18 | PBT 9 | PCT 2 | — | — | 0.03 |
| 19 | PBT 10 | PCT 2 | — | — | 0.03 |
| 20 | PBT 11 | PCT 2 | — | — | 0.03 |
| 21 | PBT 12 | PCT 2 | — | — | 0.03 |
| 22 | PBT 2 | PCT 3 | — | — | 0.57 |
| 23 | PBT 2 | PCT 4 | — | — | 0.57 |
| 24 | PBT 2 | PCT 5 | — | — | 0.57 |
| 25 | PBT 2 | PCT 2 | PMT 2 | PYT 2 | 0.55 to 0.57 |

PBT: Polymerization Black Toner
PCT: Polymerization Cyan Toner
PMT: Polymerization Magenta Toner
PYT: Polymerization Yellow Toner

TABLE 5

| Example: | Charge stability | Toner scatter | Fog | Image uniformity/ image quality | Fine-line reproducibility |
|---|---|---|---|---|---|
| 11 | A | A | A | A | 101 |
| 12 | B | B | B | B | 102 |
| 13 | B | B | B | B | 103 |
| 14 | C | C | C | C | 104 |
| 15 | B | B | B | B | 103 |
| 16 | B | B | B | B | 104 |
| 17 | B | B | B | B | 105 |
| 18 | B | A | A | A | 102 |
| 19 | A | A | A | B | 103 |
| 20 | A | B | B | B | 104 |
| 21 | B | B | B | C | 105 |
| 22 | B | A | A | A | 103 |
| 23 | B | B | B | B | 104 |
| 24 | C | C | C | B | 106 |
| 25 | A | A | A | A | 102 |

What is claimed is:

1. An image forming apparatus comprising a single electrostatic latent image bearing member and a cyclic image forming unit group i) which is provided in a circular arrangement with a plurality of image forming units each having a replenishing developer cartridge containing a replenishing developer, and a developing assembly, and forming respective different-color toner images on the electrostatic latent image bearing member and ii) which is so constructed that each image forming unit is rotatively movable to a development position;

an exposure position and a development position at the time of forming respective-color toner images being the same for each color;

the respective-color toner images formed on the electrostatic latent image bearing member being superimposingly transferred under registration onto a recording medium via, or not via, an intermediate transfer member, and the respective-color toner images formed on the electrostatic latent image bearing member being transferred to the recording medium or the intermediate transfer member at the same transfer position;

at least one of the image forming units being a special-color image forming unit having a special-color replenishing developer cartridge containing a special-color color component replenishing developer, and at least one of the other image forming units being a non-special-color image forming unit having a non-special-color replenishing developer cartridge containing a non-special-color color component replenishing developer other than the special-color color component replenishing developer;

the special-color image forming unit performing image formation by the use of a two-component developer containing a carrier and a toner;

the special-color replenishing developer cartridge having a volume larger than the volume of the non-special-color replenishing developer cartridge; and the special-color color component replenishing developer containing a carrier and a toner.

2. The image forming apparatus according to claim 1, wherein the image forming units of said cyclic image forming unit group are deposited at a regular interval.

3. The image forming apparatus according to claim 1, wherein said special-color color component replenishing developer is a black replenishing developer.

4. The image forming apparatus according to claim 1, wherein said special-color color component replenishing developer contains the toner in an amount of from 1 part by weight to 30 parts by weight based on 1 part by weight of the carrier.

5. The image forming apparatus according to claim 1, wherein said carrier has a true specific gravity of from 2.5 $g/cm^3$ to 4.5 $g/cm^3$.

6. The image forming apparatus according to claim 1, wherein said carrier is a magnetic-fine-particle-dispersed carrier obtained by polymerization and contains at least magnetic fine particles and a binder resin.

7. The image forming apparatus according to claim 1, wherein said toner is a toner produced by subjecting a polymerizable monomer composition containing at least a polymerizable monomer and a colorant, to polymerization in an aqueous medium in the presence of a polymerization initiator.

8. A replenishing developer kit having replenishing developer cartridges holding therein replenishing developers, with respect to at least two-color color components;

of the replenishing developer cartridges, at least one special-color replenishing developer cartridge holding therein a special-color color component replenishing developer having a volume larger than the volume of at least one non-special-color replenishing developer cartridge holding therein a non-special-color color component replenishing developer other than the special-color color component replenishing developer; and the special-color color component replenishing developer containing a carrier and a toner.

9. The replenishing developer kit according to claim 8, wherein said special-color color component replenishing developer is a black replenishing developer.

10. The replenishing developer kit according to claim 8, wherein said special-color color component replenishing developer contains the carrier and the toner, and contains the toner in an amount of from 1 part by weight to 30 parts by weight based on 1 part by weight of the carrier.

11. The replenishing developer kit according to claim 8, wherein said carrier has a true specific gravity of from 2.5 $g/cm^3$ to 4.5 $g/cm^3$.

12. The replenishing developer kit according to claim 8, wherein said carrier is a magnetic-fine-particle-dispersed carrier obtained by polymerization and contains at least magnetic fine particles and a binder resin.

13. The replenishing developer kit according to claim 8, wherein said toner is a toner produced by subjecting a polymerizable monomer composition containing at least a polymerizable monomer and a colorant, to polymerization in an aqueous medium in the presence of a polymerization initiator.

14. An image forming apparatus comprising (I) an image forming unit group having i) a plurality of movable image forming units which form respective different-color toner images on a single electrostatic latent image bearing member having a single image formation position constituted of a single exposure position and a single transfer position, the image forming units being disposed in a circular arrangement, and ii) replenishing developer cartridges, and (II) a moving means for rotatively moving the whole image forming unit group in order to move each of the image forming units to the single image formation position in order; different-color toner images being superimposingly transferred under registration onto a recording medium via, or not via, an intermediate transfer member to form a color image, wherein;

the replenishing developer kit according to any one of claims 8 to 13 is used in the image forming apparatus.

15. An image forming apparatus comprising a plurality of electrostatic latent image bearing members and a plurality of image forming units corresponding respectively to the electrostatic latent image bearing members;

the image forming units each having a replenishing developer cartridge containing a replenishing developer, and a developing assembly, and forming respectively different-color toner images on the electrostatic latent image bearing members;

at least one of the image forming units being a special-color image forming unit having a special-color replenishing developer cartridge containing a special-color color component replenishing developer, and at least one of the other image forming units being a non-special-color image forming unit having a non-special-color replenishing developer cartridge containing a non-special-color color component replenishing developer other than the special-color color component replenishing developer;

the special-color image forming unit being an image performing image formation by the use of a two-component developer containing a carrier and a toner;

the special-color replenishing developer cartridge having a volume larger than the volume of the non-special-color replenishing developer cartridge; and the special-color color component replenishing developer containing a carrier and a toner.

16. The image forming apparatus according to claim 15, wherein said special-color color component replenishing developer is a black replenishing developer.

17. The image forming apparatus according to claim 15, wherein said special-color color component replenishing developer contains the toner in an amount of from 1 part by weight to 30 parts by weight based on 1 part by weight of the carrier.

18. The image forming apparatus according to claim 15, wherein said carrier has a true specific gravity of from 2.5 $g/cm^3$ to 4.5 $g/cm^3$.

19. The image forming apparatus according to claim 15, wherein said carrier is a magnetic-fine-particle-dispersed carrier obtained by polymerization and contains at least magnetic fine particles and a binder resin.

20. The image forming apparatus according to claim 15, wherein said toner is a toner produced by subjecting a polymerizable monomer composition containing at least a polymerizable monomer and a colorant, to polymerization in an aqueous medium in the presence of a polymerization initiator.

21. An image forming apparatus comprising a single electrostatic latent image bearing member and a plurality of image forming units which each have a replenishing developer cartridge containing a replenishing developer, and a developing assembly, and which form respective different-color toner images on the electrostatic latent image bearing member;

at least one of the image forming units being a special-color image forming unit having a special-color replenishing developer cartridge containing a special-color color component replenishing developer, and at least one of the other image forming units being a non-special-color image forming unit having a non-special-color replenishing developer cartridge containing a non-special-color color component replenishing developer other than the special-color color component replenishing developer;

the special-color image forming unit performing image formation by the use of a two-component developer containing a carrier and a toner;

the special-color replenishing developer cartridge having a volume larger than the volume of the non-special-color replenishing developer cartridge; and the special-color color component replenishing developer containing a carrier and a toner.

22. The image forming apparatus according to claim 21, wherein said special-color color component replenishing developer is a black replenishing developer.

23. The image forming apparatus according to claim 21, wherein said special-color color component replenishing developer contains the toner in an amount of from 1 part by weight to 30 parts by weight based on 1 part by weight of the carrier.

24. The image forming apparatus according to claim 21, wherein said carrier has a true specific gravity of from 2.5 $g/cm^3$ to 4.5 $g/cm^3$.

25. The image forming apparatus according to claim 21, wherein said carrier is a magnetic-fine-particle-dispersed carrier obtained by polymerization and contains at least magnetic fine particles and a binder resin.

26. The image forming apparatus according to claim 21, wherein said toner is a toner produced by subjecting a polymerizable monomer composition containing at least a polymerizable monomer and a colorant, to polymerization in an aqueous medium in the presence of a polymerization initiator.

* * * * *

UNITED STATES PATENT AND TRADEMARK OFFICE

CERTIFICATE OF CORRECTION

PATENT NO. : 7,024,138 B2
APPLICATION NO. : 10/765033
DATED : April 4, 2006
INVENTOR(S) : Naotaka Ikeda et al.

It is certified that error appears in the above-identified patent and that said Letters Patent is hereby corrected as shown below:

COLUMN 2:

Line 3, “so” should read --such--; and
Line 60, “complicate” should read --complicated--.

COLUMN 6:

Line 12, “a” should read --an--.

COLUMN 7:

Line 24, “in” should read --at in--.

COLUMN 10:

Line 12, “is overflowed from a developer” should be deleted; and
Line 13, “discarding opening 34,” should be deleted.

COLUMN 16:

Line 46, “comes” should read --becomes--.

COLUMN 19:

Line 2, “what are aimed in” should read --the aims of--.

COLUMN 22:

Line 14, “a” should read --in order to maintain a--.

COLUMN 26:

Line 64, “cooled,” should read --cooling,--.

COLUMN 30:

Line 28, “Co.). Evaluated” should read --Co.), and was evaluated--.

UNITED STATES PATENT AND TRADEMARK OFFICE

CERTIFICATE OF CORRECTION

PATENT NO. : 7,024,138 B2
APPLICATION NO. : 10/765033
DATED : April 4, 2006
INVENTOR(S) : Naotaka Ikeda et al.

It is certified that error appears in the above-identified patent and that said Letters Patent is hereby corrected as shown below:

COLUMN 31:

Line 3, "for changing" should be deleted;
Line 7, "replaced is," should read --replaced,--; and
Line 66, "adhere" should read --adhered--.

COLUMN 32:

Line 36, "little" should be deleted; and
Line 50, "little large" should read --slightly excessive--.

COLUMN 37:

Line 9, "between" should be deleted.

COLUMN 39:

Line 12, "a" should read --there occurs a--; and
Line 13, "occurred" should be deleted.

Signed and Sealed this

Fifth Day of December, 2006

JON W. DUDAS
*Director of the United States Patent and Trademark Office*